US009666949B2

(12) United States Patent
Miller et al.

(10) Patent No.: US 9,666,949 B2
(45) Date of Patent: May 30, 2017

(54) PARTIALLY DIELECTRIC LOADED ANTENNA ELEMENTS FOR DUAL-POLARIZED ANTENNA

(71) Applicant: ViaSat, Inc., Carlsbad, CA (US)

(72) Inventors: Matthew J. Miller, Buford, GA (US); Dominic Q. Nguyen, Irvine, CA (US); Donald L. Runyon, Peachtree Corners, GA (US); James W. Maxwell, Alpharetta, GA (US); John D. Voss, Cumming, GA (US)

(73) Assignee: ViaSat, Inc., Carlsbad, CA (US)

( * ) Notice: Subject to any disclaimer, the term of this patent is extended or adjusted under 35 U.S.C. 154(b) by 37 days.

(21) Appl. No.: 14/849,437

(22) Filed: Sep. 9, 2015

(65) Prior Publication Data

US 2017/0069972 A1 Mar. 9, 2017

(51) Int. Cl.
*H01Q 13/02* (2006.01)
*H01Q 15/24* (2006.01)
(Continued)

(52) U.S. Cl.
CPC ..... *H01Q 13/02* (2013.01); *H01Q 13/025* (2013.01); *H01Q 13/0258* (2013.01);
(Continued)

(58) Field of Classification Search
CPC .. H01Q 13/02; H01Q 13/025; H01Q 13/0258; H01Q 13/06; H01Q 15/24; H01Q 21/0037
See application file for complete search history.

(56) References Cited

U.S. PATENT DOCUMENTS 3,955,202 A * 5/1976 Young ..... H01Q 13/0241 333/21 A
6,201,508 B1 3/2001 Metzen et al.
(Continued)

FOREIGN PATENT DOCUMENTS

CN 101183747 A 5/2008
JP 2010004436 A 5/1976
(Continued)

OTHER PUBLICATIONS

European Search Report and Opinion dated Jan. 26, 2017 for Appl No. 16187484.7, 9 pgs.

*Primary Examiner* — Hoang Nguyen
(74) *Attorney, Agent, or Firm* — Holland & Hart LLP

(57) ABSTRACT

A partially dielectric loaded divided horn waveguide device for a dual-polarized antenna is described. The partially dielectric loaded divided horn waveguide device may include a polarizer, a waveguide horn, multiple individual waveguides dividing a horn port of the waveguide horn, and multiple dielectric elements partially filling the individual waveguides. The dielectric elements may include a dielectric member extending along a corresponding individual waveguide and one or more matching features for matching signal propagation between the partially dielectric loaded individual waveguides and free space. Various components of the partially dielectric loaded divided horn waveguide device may be tuned for enhanced signal propagation between the waveguide horn and the individual waveguides, and between the individual waveguides and free space.

29 Claims, 19 Drawing Sheets

(51) Int. Cl.
*H01Q 13/06* (2006.01)
*H01Q 21/00* (2006.01)

(52) U.S. Cl.
CPC ..... *H01Q 13/06* (2013.01); *H01Q 15/24* (2013.01); *H01Q 21/0037* (2013.01)

(56) References Cited

U.S. PATENT DOCUMENTS

| | | | | |
|---|---|---|---|---|
| 6,211,838 | B1 | 4/2001 | Cherrette et al. | |
| 7,379,030 | B1 | 5/2008 | Lier | |
| 9,112,279 | B2 * | 8/2015 | Montgomery ..... | H01Q 13/0275 |
| 2011/0043422 | A1 | 2/2011 | Lin et al. | |
| 2015/0288068 | A1 * | 10/2015 | Suematsu ..... | H01Q 13/0258 343/776 |
| 2016/0020519 | A1 | 1/2016 | Park et al. | |

FOREIGN PATENT DOCUMENTS

| | | | |
|---|---|---|---|
| WO | WO 2008/069358 | A1 | 6/2008 |
| WO | WO 2014073445 | A1 | 5/2014 |

* cited by examiner

PARTIALLY DIELECTRIC LOADED ANTENNA ELEMENTS FOR DUAL-POLARIZED ANTENNA

BACKGROUND

Antenna arrays including waveguide antenna elements are becoming an important communication tool because they provide desirable antenna gain and beamforming properties for communication over long distances. Passive antenna arrays with waveguide feed networks are one of the most suited technologies for antenna arrays because of the low level of losses they exhibit.

A traditional limitation with waveguide antenna elements is operational bandwidth range. For example, waveguides typically have a lower cutoff frequency that is dependent on the dimensions of the waveguide, and an operational range that is a fraction of an octave starting at a frequency above the lower cutoff frequency. However, various applications may call for a wider operational bandwidth. For example, it may be desirable to support frequencies in portions of the Ku-band, K-band, and Ka-bands, which range from 12 GHz to 40 GHz. Additionally, a communication system may be configured for transmission and reception over two different frequency ranges, which may be discontinuous. Current antenna arrays using waveguide antenna elements have bandwidth limitations that reduce their capabilities or ability to communicate with various satellite systems.

SUMMARY

Methods, systems, and devices are described for a partially dielectric loaded divided horn waveguide device for a dual-polarized antenna. The partially dielectric loaded divided horn waveguide device may include a polarizer, a waveguide horn, multiple individual waveguides dividing a horn port of the waveguide horn, and multiple dielectric elements partially filling the individual waveguides. The dielectric elements may include a dielectric member extending along a corresponding individual waveguide and one or more matching features for matching signal propagation between the partially dielectric loaded individual waveguides and free space and extending into free space and/or the horn. Various components of the partially dielectric loaded divided horn waveguide device may be tuned for enhanced signal propagation between the waveguide horn and the individual waveguides, and between the individual waveguides and free space.

A dual-polarized antenna including a plurality of unit cells is described. In aspects, each unit cell includes a polarizer coupled between a common waveguide and first and second divided waveguides associated with first and second polarizations, respectively, a waveguide horn coupled between the common waveguide and a horn port, the waveguide horn having a transition section of increasing waveguide cross-sectional size from the common waveguide to the horn port, a plurality of individual waveguides dividing the horn port of the waveguide horn, and a plurality of dielectric elements partially filling the plurality of individual waveguides, each dielectric element within a corresponding individual waveguide of the plurality of individual waveguides.

A method for designing a partially dielectric loaded dual-polarized antenna is described. The method may include identifying an operational frequency range for the dual-polarized antenna, wherein the dual-polarized antenna comprises a plurality of individual waveguides, and wherein a subset of individual waveguides of the plurality of individual waveguides are coupled with a common waveguide of a polarizer via a waveguide horn having a transition section of increasing waveguide cross-sectional size from the common waveguide to the subset of individual waveguides, determining dimensions of the plurality of individual waveguides for the dual-polarized antenna based on the operational frequency range, providing a dielectric element partially filling a corresponding individual waveguide of the plurality of individual waveguides, and iteratively adjusting one or more features of the dielectric element and calculating one or more performance metrics of the dual-polarized antenna until one or more of the calculated one or more performance metrics reach predetermined performance values at one or more frequencies within the operational frequency range.

Further scope of the applicability of the described methods and apparatuses will become apparent from the following detailed description, claims, and drawings. The detailed description and specific examples are given by way of illustration only, since various changes and modifications within the scope of the description will become apparent to those skilled in the art.

BRIEF DESCRIPTION OF THE DRAWINGS

A further understanding of the nature and advantages of embodiments of the present disclosure may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

Figure 1:
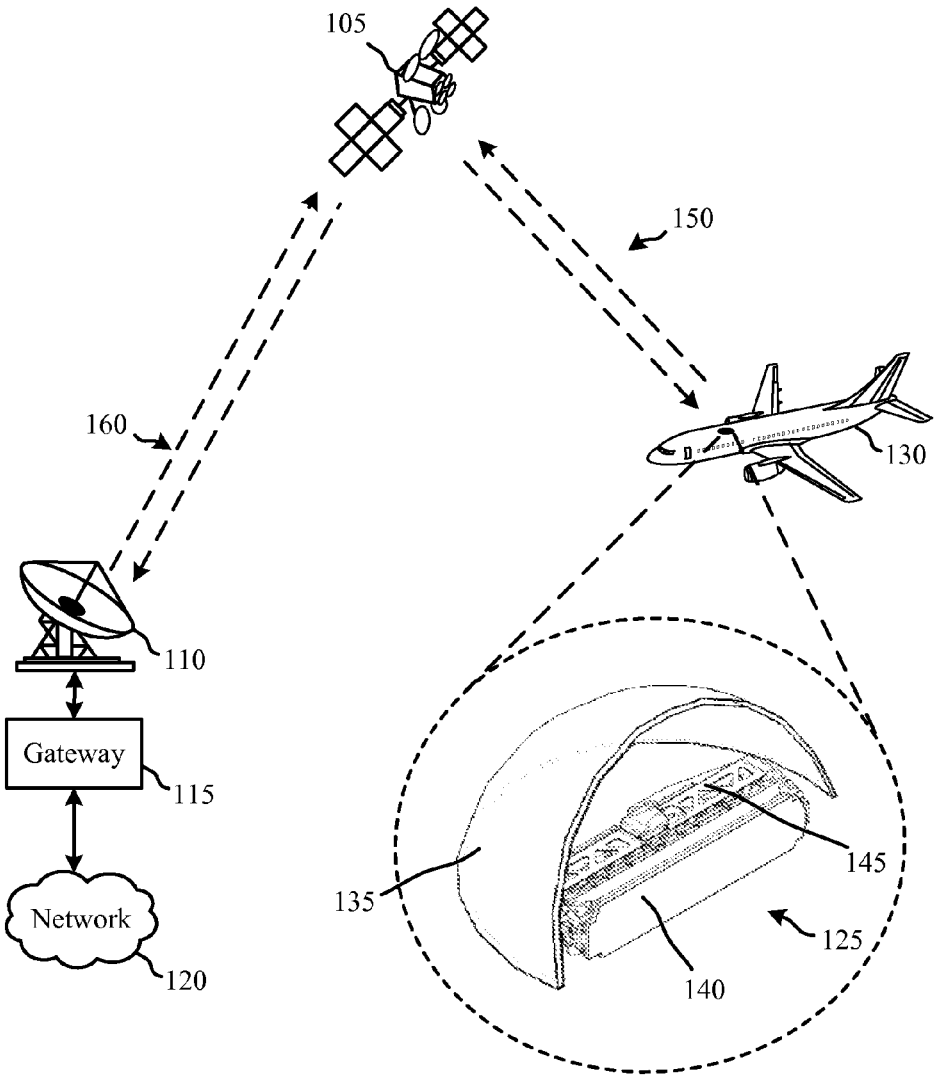
FIG. 1 shows a diagram of a satellite communication system in accordance with various aspects of the present disclosure.

The described features generally relate to a partially dielectric loaded divided horn waveguide device for a dual-polarized antenna. The partially dielectric loaded divided horn waveguide device (also described herein as a "unit cell") may include a polarizer (e.g., septum polarizer, etc.), a waveguide horn, multiple individual waveguides dividing a horn port of the waveguide horn, and multiple dielectric elements partially filling the individual waveguides. The dielectric elements may include a dielectric member extending along a corresponding individual waveguide and one or more matching features for matching signal propagation between the partially dielectric loaded individual waveguides and free space. The dielectric elements may extend beyond the individual waveguides and may extend into the waveguide horn.

The dielectric element partially filling the individual waveguides can provide improved performance of the antenna. In embodiments in which each of the individual waveguides operate as (or are coupled) to individual antenna elements, the improvement generally arises where the antenna requirements include grating lobe free operation at the highest operating frequency and also operation over a wide bandwidth. Designing a lattice array of antenna elements that are grating lobe free can be accomplished with an element spacing of equal to or less than one wavelength at the highest operating frequency for a non-electrically steered antenna. Thus, the desire to suppress grating lobes at the highest operating frequency drives antenna design towards including small antenna elements that are spaced close together. However, this constraint creates difficulties at efficiently radiating the lower end of the operating bandwidth in embodiments in which the bandwidth is large. Without dielectric loading, at the lower end of the frequency of operation of the antenna, the individual waveguides may approach cutoff conditions and/or not propagate energy efficiently. Loading the individual waveguides with a dielectric material improves the transmission at the lower frequency end of the operating bandwidth. Thus, the dielectric insert partially loads the individual waveguides enough to facilitate communication at the lower frequencies, but not so much as to result in degeneration of signals into higher order modes at the higher frequencies of the operational bandwidth. The dielectric elements are described in more detail below.

An interface between the waveguide horn and multiple individual waveguides may include features on the individual waveguides, waveguide horn, and dielectric elements that assist in collecting and distributing energy between the multiple separate signals in the individual waveguides and common signals in the waveguide horn. For example, the dielectric member of the dielectric elements may extend into the waveguide horn and may have one or more transverse features that extend from the center of the individual waveguides toward the walls of the individual waveguides. The extension of the dielectric member into the waveguide horn may include tapered sections. The dielectric member may also include tapered sections on the transverse features between the extension section and the matching features.

This description provides examples, and is not intended to limit the scope, applicability or configuration of embodiments of the principles described herein. Rather, the ensuing description will provide those skilled in the art with an enabling description for implementing embodiments of the principles described herein. Various changes may be made in the function and arrangement of elements.

Thus, various embodiments may omit, substitute, or add various procedures or components as appropriate. For instance, it should be appreciated that the methods may be performed in an order different than that described, and that various steps may be added, omitted or combined. Also, aspects and elements described with respect to certain embodiments may be combined in various other embodiments. It should also be appreciated that the following systems, methods, devices, and software may individually or collectively be components of a larger system, wherein other procedures may take precedence over or otherwise modify their application.

FIG. 1 shows a diagram of a satellite communication system 100 in accordance with various aspects of the present disclosure. The satellite communication system 100 includes a satellite 105, a gateway 115, a gateway antenna system 110, and an aircraft 130. The gateway 115 communicates with one or more networks 120. In operation, the satellite communication system 100 provides for two-way communications between the aircraft 130 and the network 120 through the satellite 105 and the gateway 115.

The satellite 105 may be any suitable type of communication satellite. In some examples, the satellite 105 may be in a geostationary orbit. In other examples, any appropriate orbit (e.g., low earth orbit (LEO), medium earth orbit (MEO), etc.) for satellite 105 may be used. The satellite 105 may be a multi-beam satellite configured to provide service for multiple service beam coverage areas in a predefined geographical service area. In some examples, the satellite communication system 100 includes multiple satellites 105.

The gateway antenna system 110 may be two-way capable and designed with adequate transmit power and receive sensitivity to communicate reliably with the satellite system 105. The satellite system 105 may communicate with the gateway antenna system 110 by sending and receiving signals through one or more beams 160. The gateway 115 sends and receives signals to and from the satellite system 105 using the gateway antenna system 110. The gateway 115 is connected to the one or more networks 120. The networks 120 may include a local area network (LAN), metropolitan area network (MAN), wide area network (WAN), or any other suitable public or private network and may be connected to other communications networks such as the Internet, telephony networks (e.g., Public Switched Telephone Network (PSTN), etc.), and the like.

The aircraft 130 includes a communication system including an antenna assembly 125, which may be mounted on the outside of the fuselage of aircraft 130 under a radome 135. The antenna assembly 125 includes dual-polarized antenna 140, which may be used by the aircraft 130 to communicate (e.g., uni-directionally or bi-directionally, etc.) with the satellite 105 over one or more beams 150. In some examples, the satellite communication system 100 may operate over multiple carrier frequencies and/or using multiple polarizations. For example, the satellite 105 may be a multi-beam satellite and may use different carrier frequencies and/or different polarizations in adjacent and/or partially overlapping satellite beams. The dual-polarized antenna 140 may be configured to receive signals of a first satellite beam having a first polarization state (e.g., linear polarization, circular polarization, etc.) while providing isolation to an adjacent or partially overlapping beam having the same carrier frequencies and a second, orthogonal polarization state. Similarly, transmissions from multiple antennas to the satellite 105 (e.g., multiple aircraft or ground-based terminals, etc.) may use orthogonal polarizations for simultaneous reception by the satellite 105. Simultaneous transmission and reception of signals by the antenna 140 may be performed using the same frequency range, or different frequency ranges, in some cases.

In antenna assembly 125, the dual-polarized antenna 140 may be mounted to a positioner 145 used to point the dual-polarized antenna 140 at the satellite 105 (e.g., actively tracking) during operation. The dual-polarized antenna 140 may operate in a variety of frequency bands such as the International Telecommunications Union (ITU) Ku, K, or Ka-bands, for example from approximately 11 to 31 Giga-Hertz (GHz). Alternatively, the dual-polarized antenna 140 may operate in other frequency bands such as C-band, X-band, S-band, L-band, and the like.

The on-board communication system of the aircraft 130 may provide communication services for communication devices of the aircraft 130 via a modem (not shown). Communication devices may connect to and access the networks 120 through the modem. For example, mobile devices may communicate with one or more networks 120 via network connections to modem, which may be wired or wireless. A wireless connection may be, for example, of a wireless local area network (WLAN) technology such as IEEE 802.11 (Wi-Fi), or other wireless communication technology.

The size of the dual-polarized antenna 140 may directly impact the size of the radome 135, for which a low profile may be desired. In other examples, other types of housings are used with the dual-polarized antenna 140. Additionally, the dual-polarized antenna 140 may be used in other applications besides onboard the aircraft 130, such as onboard boats, vehicles, or on ground-based stationary systems.

For antennas using waveguide elements for radiating and/or receiving energy, the operational frequency range of the antenna array may be determined by the dimensions of each of the waveguide elements. For example, a lower cutoff frequency for each waveguide element may be dependent on the cross-sectional dimensions of the waveguide element. Generally, as the operational frequency approaches the lower cutoff frequency, the transmission efficiency of signal propagation decreases. Transmission efficiency may also decline as the operational frequency approaches one octave above (i.e., 2×) the lower cutoff frequency for conventional waveguide, and the appearance of more complex or multi-mode propagation at frequencies approaching 2 times the lower cutoff frequency may generate significant undesired waveguide modes and radiation pattern effects (e.g., grating or side lobes, etc.). Thus, the operational frequency range for an antenna using waveguide elements may be in a range between 1× and 2× of the cutoff frequency (e.g., 1.2× to 1.8× of the cutoff frequency, etc.) for conventional non-ridge loaded waveguide and between 1× and 3.5× of the cutoff frequency for some ridge-loaded waveguides. Typically, the operational frequency range for a conventional waveguide device is constrained to a range of approximately 1.5× of the lower operational frequency limit.

However, in some applications, it may be desired to have an antenna that can operate over a frequency range where the highest frequency of operation is greater than 1.5× the lower operational frequency, and a desired range may span a frequency range from a lower bound to close to 2× of the lower bound. For example, operational frequency bands for satellite communications in the Ku, K, and Ka bands may extend over a range of 17 to 31 GHz corresponding to a range of 1.75×, with different ranges available for operation in different countries, and it may be desired to operate in different operational frequencies that span across the available operational bands. Additionally, it may be desirable to transmit signals over one frequency range while concurrently receiving signals over another, discontinuous frequency range. For example, a receive frequency band segment may be 17.7-21.2 GHz and a corresponding transmit frequency band segment may be 27.5-31.0 GHz.

In addition, it may be desirable to keep the distance between waveguide elements in the antenna to a minimum while feeding a large number of antenna elements (e.g., greater than 1000, etc.) using continuous waveguide combiner/divider networks (e.g., with no changes in propagation medium). These waveguide combiner/divider networks may be complex and may include several stages that extend back behind the aperture plane of the antenna, increasing the depth of the antenna dramatically as the array size increases. In some applications, the depth of the antenna may be constrained by a physical enclosure (e.g., radome, etc.), and thus the overall depth of the antenna elements and waveguide combiner/divider networks may limit the number of antenna elements that can be used, thus limiting performance of the antenna.

Figure 2:
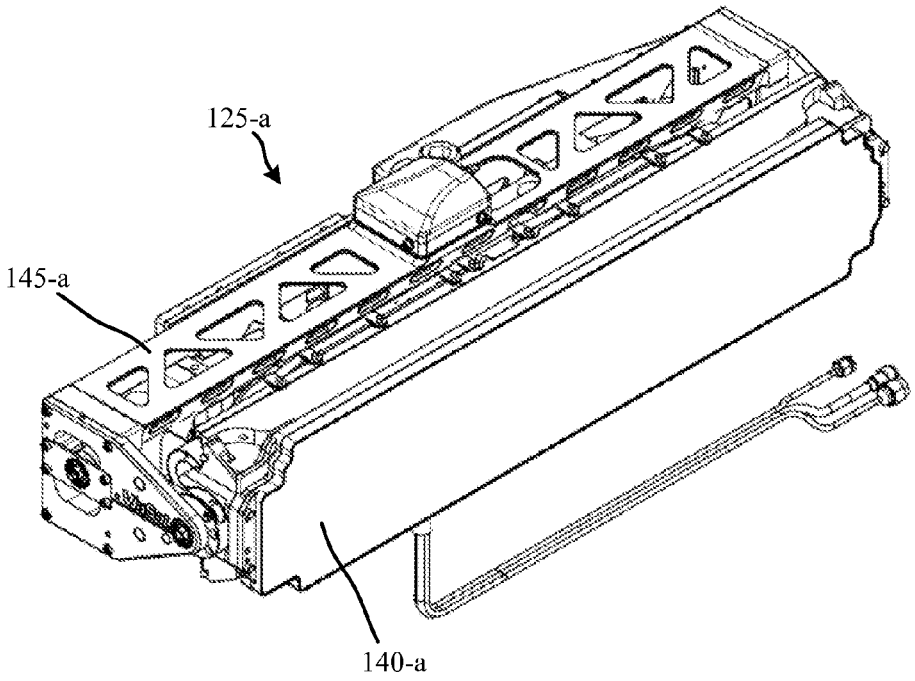
FIG. 2 shows a view of an antenna assembly in accordance with various aspects of the present disclosure.

FIG. 2 shows a view 200 of an antenna assembly 125-*a* in accordance with various aspects of the present disclosure. As shown in FIG. 2, antenna assembly 125-*a* includes dual-polarized antenna 140-*a* and positioner 145-*a*, which may be, for example, the antenna 140 and positioner 145 illustrated in FIG. 1. The positioner 145-*a* may include an elevation motor and gearbox, an elevation position sensor, an azimuth motor and gearbox, and an azimuth position sensor. These components may be used to point the dual-polarized antenna 140-*a* at the satellite (e.g., satellite 105 in FIG. 1) during operation.

Figure 3:
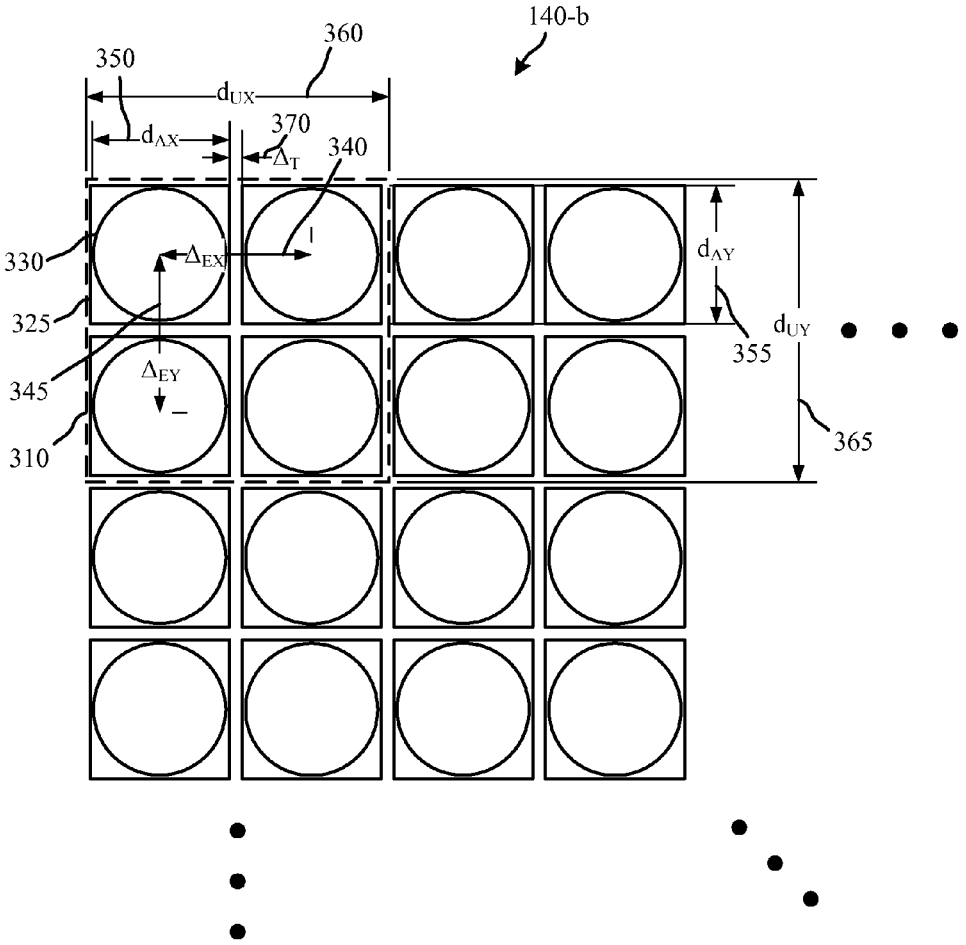
FIG. 3 shows a diagram of a front view of a dual-polarized antenna in accordance with various aspects of the present disclosure.

FIG. 3 shows a diagram of a front view 300 of a dual-polarized antenna 140-*b* in accordance with various aspects of the present disclosure. The dual-polarized antenna 140-*b* may illustrate aspects of the dual-polarized antennas 140 of FIG. 1 or 2.

Dual-polarized antenna 140-*b* may have a planar horn antenna aperture that includes multiple antenna elements, described herein as individual waveguides 325 (of which only one is labeled for clarity). Individual waveguides 325 may be arranged (e.g., in an array, etc.) for beamforming of transmitted and/or received signals. Each individual waveguide 325 may have a rectangular cross-section and the individual waveguides 325 may have inter-element distances $\Delta_{EX}$ 340 and $\Delta_{EY}$ 345, which may be related to the desired operational frequency range and may be equal to each other. For example, $\Delta_{EX}$ 340 and $\Delta_{E}$y 345 may be related to the wavelength at the highest operating frequency (e.g., to provide grating lobe free operation at the highest operating frequency, etc.). Each individual waveguide 325 shares waveguide walls with at least two other individual waveguides 325, and the individual waveguides 325 may have a width $d_{AX}$ 350 and height $d_{AY}$ 355, which may be determined by the inter-element distances $\Delta_{EX}$ 340 and $\Delta_{EY}$ 345 and a thickness $\Delta_T$ 370 of the waveguide walls that is sufficient for structural integrity of the individual waveguides 325.

For functional capability, efficiency, and performance, each individual waveguide 325 may support dual-polarized operation. For example, when a signal is transmitted via dual-polarized antenna 140-*b* using a first polarization, it may be desired that all individual waveguides 325 in the antenna 140-*b* are part of the beamforming network transmitting the signal. Similarly, when a signal wave is received by dual-polarized antenna 140-*b* of the same polarization or a different (e.g., orthogonal) polarization, it may be desired that energy received by all individual waveguides 325 is combined in the beamforming network for the received signal power. In some cases, each individual waveguide 325 may transmit energy using a first polarization and receive energy of a second (e.g., orthogonal) polarization concurrently.

Thus, it may be desired for the dual-polarized antenna 140-*b* to include dual-polarized individual waveguides 325 having reduced inter-element spacing and supporting a wide operational bandwidth range (e.g., a bandwidth range from a lower operational frequency $f_L$ to an upper operational frequency $f_H \geq 1.5 \cdot f_L$). In addition, it is desirable to maintain equal path lengths between waveguide networks feeding each individual waveguide 325. These operational parameters may be difficult to achieve with conventional waveguide antenna architectures.

In embodiments of the antennas 140 of FIGS. 1, 2, and 3, the dual-polarized antenna 140 includes multiple unit cells 310, where each unit cell 310 includes multiple individual waveguides 325 coupled with the common waveguide of a shared polarizer (e.g., septum polarizer) via a waveguide horn and each individual waveguide 325 includes a dielectric element 330 at least partially filling the individual waveguide 325. The dielectric elements 330 may include one or more matching features for matching signal propagation between the corresponding individual waveguide 325 loaded by the dielectric element 330 and free space. The dielectric elements 330 may have a dielectric member (not shown) extending along the corresponding individual waveguide 325 and the dielectric member may extend at least partially into the waveguide horn. The dielectric elements 330 may be self-supported and may lock into place in the individual waveguides 325 even in the presence of vibration or shock occurring to the dual-polarized antenna 140 in operation. The dielectric elements 330 may extend beyond the aperture face (e.g., the front surface of individual waveguides 325).

In some examples, each unit cell 310 may include a 4:1 power combiner/divider ratio between the polarizer and the individual waveguides 325, which may be arranged in a 2-by-2 array having inter-element distances $\Delta_{EX}$ 340 and $\Delta_{EY}$ 345. To achieve the same inter-element distances $\Delta_{EX}$ 340 and $\Delta_{EY}$ 345 between individual waveguides 325 across the antenna 140-*b*, each unit cell 310 may have a width $d_{UX}$ 360 given by $d_{UX}=2\cdot\Delta_{EX}$ and a height $d_{UY}$ 365 given by $d_{UY}=2\cdot\Delta_{EY}$, with the 4:1 power combiner/divider and polarizer being within the unit-cell boundary defined by the cross-section having width $d_{UX}$ 360 and height $d_{UY}$ 365.

In some examples, the wall thickness $\Delta_T$ may be less than 0.25, or in some cases less than 0.2, 0.15, or 0.1 of the inter-element distances $\Delta_{EX}$ 340 and $\Delta_{EY}$ 345. Thus, the ratio of the cross-sectional width $d_{UX}$ 360 or height $d_{UY}$ 365 of the unit cell 310, to the width $d_{AX}$ 350 or height $d_{AY}$ 355 of the individual waveguides 325, respectively, may be less than 2.5. However, the ratio may be different for different inter-element distances $\Delta_{EX}$ 340 and $\Delta_{EY}$ 345, and may generally be smaller for individual waveguides 325 supporting lower frequencies (i.e., larger individual waveguides 325). In one embodiment, the described four-element unit cell 310 has a transmit frequency range of 27.5-31.0 GHz and a receive frequency range of 17.7-21.2 GHz.

Figure 4A:
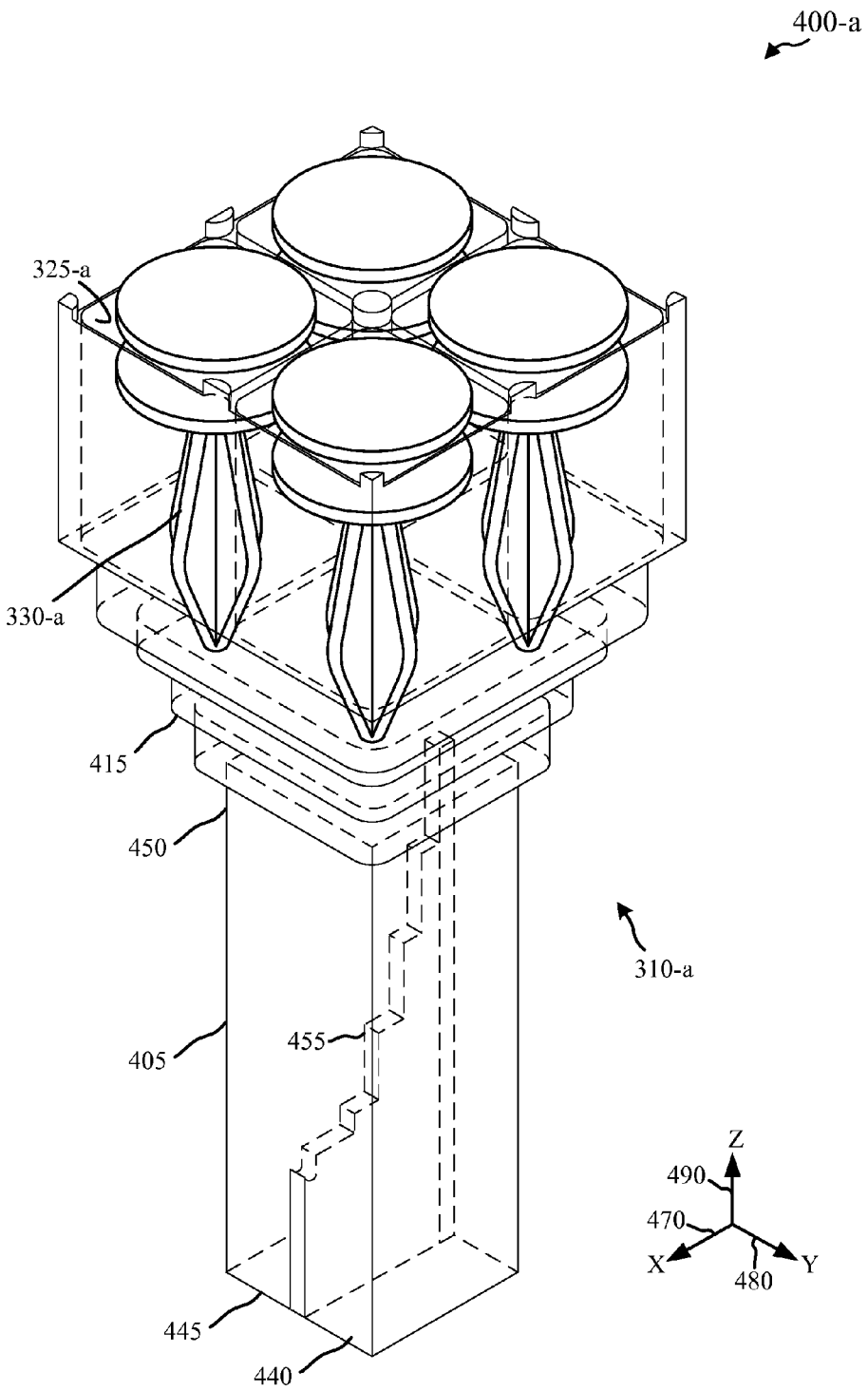
FIGS. 4A-4C show views of an example unit cell for a dual-polarized antenna in accordance with various aspects of the present disclosure.
Figure 4B:
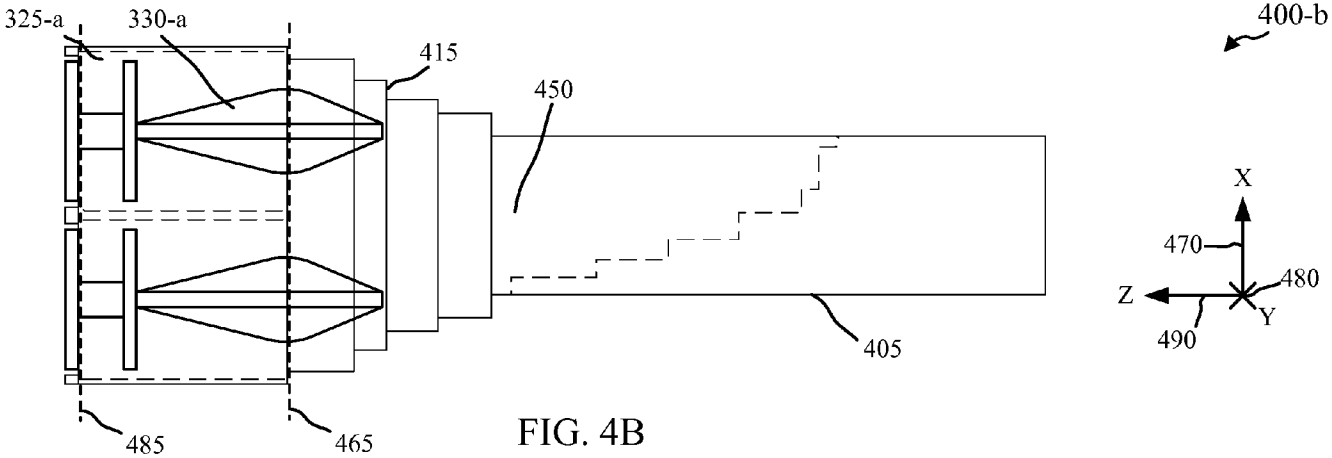
Figure 4C:
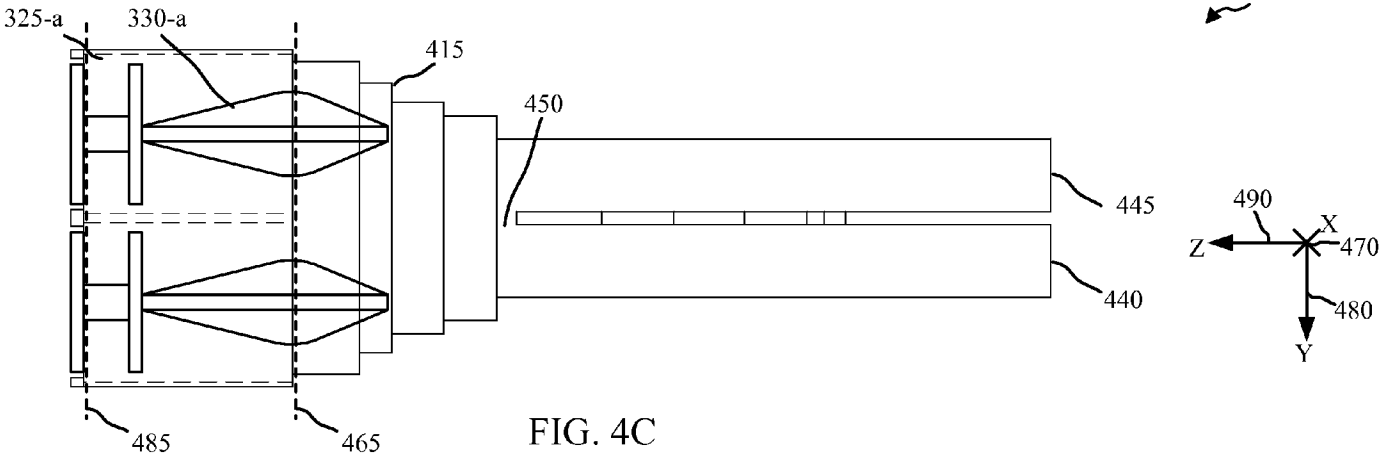

FIGS. 4A-4C show views of an example unit cell 310-*a* for a dual-polarized antenna in accordance with various aspects of the present disclosure. Unit cell 310-*a* may illustrate aspects of unit cell 310 of FIG. 3. FIG. 4A shows perspective view 400-*a* of unit cell 310-*a*. As shown in view 400-*a*, unit cell 310-*a* includes a polarizer 405, waveguide horn 415, and multiple individual waveguides 325-*a* (only one individual waveguide 325-*a* is labeled for clarity). Unit cell 310-*a* includes multiple dielectric elements 330-*a*, where each dielectric element 330-*a* is inserted into a corresponding individual waveguide 325-*a*.

FIGS. 4B and 4C show side views 400-*b* and 400-*c* of unit cell 310-*a*. As can be seen in FIGS. 4B and 4C, waveguide horn 415 increases the waveguide cross-sectional size in a transverse plane (e.g., a plane defined by the X-axis 470 and the Y-axis 480) from the common waveguide 450 to horn port 465 along the Z-axis 490. Waveguide horn 415 is illustrated as a stepped waveguide horn including multiple waveguide sections of increasing cross-sectional width. However, other examples of unit cell 310-*a* may include a waveguide horn 415 having sloped sides between the common waveguide 450 and the horn port 465. The individual waveguides 325-*a* divide the horn port 465 of the waveguide horn 415. Unit cell 310-*a* includes a 2-by-2 array of individual waveguides 325-*a* dividing horn port 465, although other arrangements (e.g., 3-by-3, 2-by-3, 2-by-4, etc.) are possible.

The polarizer 405 can convert a signal between dual polarization states in the common waveguide 450 and two signal components in the individual divided waveguides 440 and 445 that correspond to orthogonal basis polarizations. This facilitates simultaneous dual-polarized operation. For example, from a receive perspective, the polarizer 405 can be thought of as receiving a signal in the common waveguide 450, taking the energy corresponding to a first basis polarization of the signal and substantially transferring it into a first divided waveguide 440, and taking the energy corresponding to a second basis polarization of the signal and substantially transferring it into a second divided waveguide 445. From a transmit perspective, excitations of the first divided waveguide 440 and the may result in energy of the first basis polarization being emitted from the common waveguide 450 while the energy from excitations of the second divided waveguide 445 may result in energy of the second basis polarization being emitted from the common waveguide 450.

The polarizer 405 may include an element that is asymmetric to one or more modes of signal propagation. For example, the polarizer 405 may include a septum 455 configured to be symmetric to the $TE_{10}$ mode (e.g., component signals with their E-field along Y-axis 480 in common waveguide 450) while being asymmetric to the $TE_{01}$ mode (e.g., component signals with their E-field along X-axis 470 in common waveguide 450). The septum 455 may facilitate rotation of the $TE_{01}$ mode without changing signal amplitude, which may result in addition and cancellation of the $TE_{01}$ mode with the $TE_{10}$ mode on opposite sides of the septum 455. From the dividing perspective (e.g., a received signal propagating in the common waveguide 450 in the negative Z-direction), the $TE_{01}$ mode and $TE_{10}$ mode may additively combine for a signal having right hand circular polarization (RHCP) on the side of the septum 455 coupled with the first divided waveguide 440, and cancel each other on the side of the septum 455 coupled with the second divided waveguide 445. Conversely, for a signal having left hand circular polarization (LHCP), the $TE_{01}$ mode and $TE_{10}$ mode may additively combine on the side of the septum 455 coupled with the second divided waveguide 445 and cancel each other on the side of the septum 455 coupled with the first divided waveguide 440. Thus, the first and second divided waveguides 440, 445 may be excited by orthogonal basis polarizations of polarized waves incident on the common waveguide 450, and may be isolated from each other. In a transmission mode, excitations of the first and second divided waveguides 440, 445 (e.g., $TE_{10}$ mode signals) may result in corresponding RHCP and LHCP waves, respectively, emitted from the common waveguide 450.

The polarizer may be used to transmit or receive waves having a combined polarization (e.g., linearly polarized signals having a desired polarization tilt angle) at the common waveguide 450 by changing the relative phase of component signals transmitted or received via the first and second divided waveguides 440, 445. For example, two equal-amplitude components of a signal may be suitably phase shifted and sent separately to the first divided waveguide 440 and the second divided waveguide 445 of the polarizer 405, where they are converted to an RHCP wave and an LHCP wave at the respective phases by the septum 455. When emitted from the common waveguide 450, the LHCP and RHCP waves combine to produce a linearly polarized wave having an orientation at a tilt angle related to the phase shift introduced into the two components of the transmitted signal. The transmitted wave is therefore linearly polarized and can be aligned with a polarization axis of a communication system. Similarly, a wave having a combined polarization (e.g., linear polarization) incident on common waveguide 450 may be split into component signals of the basis polarizations at the divided waveguides 440, 445 and recovered by suitable phase shifting of the component signals in a receiver. Although the polarizer 405 is illustrated as a stepped septum polarizer, other types of polarizers may be used including sloped septum polarizers or other polarizers.

As can be seen in FIGS. 4A-4C, dielectric elements 330-*a* partially fill each individual waveguide 325-*a* and include features for providing impedance matching, enhancing operational frequency range, and facilitating signal propagation between waveguide horn 415 and the individual waveguides 325-*a*. For example, dielectric elements 330-*a* may lower a lower operational frequency $f_L$ of the individual waveguides 325-*a* while efficiently radiating energy for the full frequency range (e.g., meeting the operational mode constraints at the upper end of the operational bandwidth). Thus, an operational frequency range between the lower operational frequency $f_L$ and upper operational frequency $f_H$ may be enhanced. In addition, lower bandwidths may be supported with a smaller cross-sectional width of the individual waveguide 325-*a*, which may reduce the overall size of a dual-polarized antenna 140 for a given frequency range.

As illustrated in FIGS. 4A-4C, dielectric elements 330-*a* may be centrally located within the corresponding individual waveguide 325-*a* and may extend from the individual waveguides 325-*a* at least partially into the waveguide horn 415. By extending into the waveguide horn 415, dielectric elements 330-*a* may facilitate energy transfer between the waveguide horn 415 and the individual waveguides 325-*a*. For example, the dielectric elements 330-*a* may act as a field concentrator within the waveguide horn 415, facilitating propagation mode changes between the waveguide horn and the multiple individual waveguides 325-*a*.

For transmission of signals from unit cell 310-*a*, excitation of one or both of the divided waveguides 440, 445 may produce a polarized signal (e.g., circular polarization, linear polarization, etc.) travelling in the common waveguide 450 in a single mode (e.g., substantially in the single mode). As the single mode signal propagates in the transition region of the waveguide horn 415, more complex modes may develop, and the dielectric elements 330-*a* may facilitate transfer of energy to the individual waveguides 325-*a* by attracting the energy propagating in waveguide horn 415. The dielectric elements 330-*a* may also facilitate efficient propagation of energy through the individual waveguides 325-*a* and effective radiation from the individual waveguides 325-*a* to free space. For example, the dielectric element 330-*a* may include a dielectric member with transvers features and/or one or more matching features, as described in more detail below. Similarly, the dielectric elements 330-*a* may facilitate reception of polarized signals by the individual waveguides 325-*a* and propagation of energy in the individual waveguides 325-*a* in a single mode (e.g., substantially in the single mode). The dielectric elements 330-*a* may also facilitate the transition between separate single-mode signals in the individual waveguides 325-*a* and one single mode signal propagating from the waveguide horn 415 into the common waveguide 450 of the polarizer 405 for transfer of energy to the divided waveguides 440, 445. Features of the dielectric elements 330-*a* such as the amount that the dielectric elements 330-*a* extend into the waveguide horn 415 and the shape of the extension may be tuned to provide effective energy transfer between the waveguide horn 415 and individual waveguides 325-*a* for transmission and reception.

The unit cell 310-*a* may operate over one or more frequency bands, and may operate in a uni-directional (transmit or receive) mode or in a bi-directional (transmit and receive) mode. For example, the unit cell 310-*a* may be used to transmit and/or receive a dual-band signal that is characterized by operation using two signal carrier frequencies. In some instances, the unit cell 310-*a* may operate in a transmission mode for a first polarization (e.g., LHCP, first linear polarization) while operating in a reception mode for a second, orthogonal polarization in the same or a different frequency band.

Figure 5A:
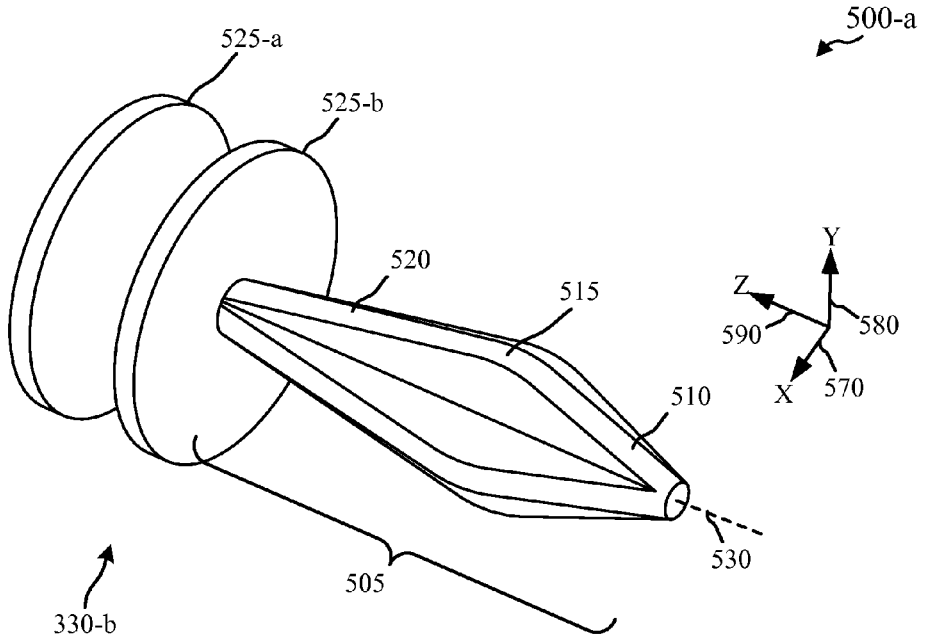
FIGS. 5A and 5B show views of an example dielectric element for a dual-polarized antenna in accordance with various aspects of the present disclosure.
Figure 5B:
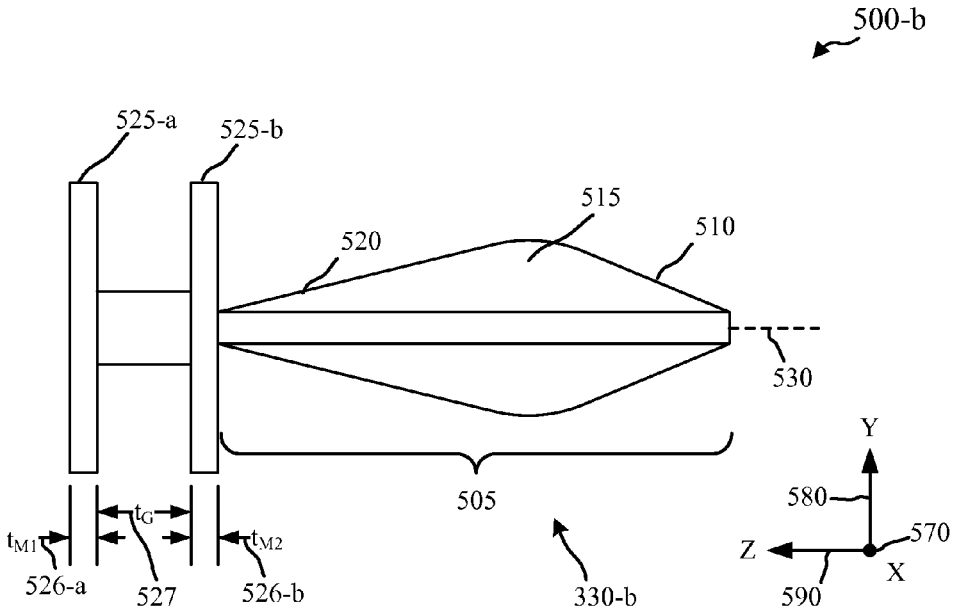

FIGS. 5A and 5B show views of an example dielectric element 330-*b* for a dual-polarized antenna in accordance with various aspects of the present disclosure. Dielectric element 330-*b* may illustrate, for example, aspects of the dielectric elements 330 for dual-polarized antennas 140 of FIGS. 1, 2, 3, and 4A-4C. Dielectric element 330-*b* may be inserted into an individual waveguide 325 of a dual-polarized antenna 140, as discussed above.

FIG. 5A illustrates a perspective view 500-*a* of dielectric element 330-*b*. Dielectric element 330-*b* may include one or more matching features 525, which may improve signal propagation matching between the dielectric loaded individual waveguide 325-*a* of the dual-polarized antenna 140 and free space. Matching features 525 may include one or more features of circular shape in a plane defined by the X-axis 570 and the Y-axis 580 with gaps along the Z-axis 590 in-between matching features. However, the matching features 525 may have other shapes (e.g., square, etc.). The matching features 525 may have a width (e.g., diameter or cross-sectional width if square) approximately equal to the cross-sectional width of the individual waveguide 325, or may have a smaller width, in some cases. The width and thickness of the matching features 525, as well as the thickness of the gaps between matching features 525, may be selected based on the desired operational performance and the dielectric constant of the material used for the dielectric element 330-*b*.

As illustrated in FIG. 5B, dielectric element 330-*b* includes two matching features 525-*a* and 525-*b*. Matching feature 525-*a* has a thickness $t_{M1}$ 526-*a* and matching feature 525-*b* has a thickness $t_{M2}$ 526-*b*, with a gap in-between matching feature 525-*a* and 525-*b* having a thickness of $t_G$ 527. The number of matching features 525, and the shape, thickness, and gap between the matching features may vary depending on the application. For example, other examples of dielectric elements 330-*b* may include only one matching feature 525, or more than two matching features 525. In addition, the shape of each matching feature 525 of dielectric elements 330-*b* may not be the same. For example, matching feature 525-*a* may be square while matching feature 525-*b* may be circular. As is illustrated in FIGS. 4A-4C, one of the matching features 525 may be partially or completely in front of a front surface 485 of the individual waveguides 325-*a*.

Dielectric element 330-*b* may include dielectric member 505. As discussed above, when dielectric element 330-*b* is inserted into a corresponding individual waveguide 325, dielectric member 505 may extend at least partially into the waveguide horn 415. Dielectric member 505 may include one or more transverse features 515 and a tapered section 510 that extends into the waveguide horn 415. As illustrated in FIG. 5, dielectric member 505 may include transverse features 515 extending towards each wall of the individual waveguide 325-*a*, and may have dual-plane symmetry in a transverse plane (e.g., a plane defined by X-axis 570 and Y-axis 580). The transverse features 515 may extend farthest out from a central axis 530 approximately where the dielectric member 505 extends from the individual waveguide 325-*a* into the waveguide horn 415 when inserted, and may include a second tapered section 520 towards the matching features 525. The transverse features 515 including tapered section 510 may assist in collecting and distributing energy between the multiple separate signals in the individual waveguides 325 and the waveguide horn 415. The second tapered section 520 may assist in transitioning energy between multiple or complex propagation modes in the interface between the waveguide horn 415 and the individual waveguides 325-*a* and single mode propagation in each of the individual waveguides 325-*a*.

Dielectric element 330-*b* may be constructed out of a material selected for its electrical properties, manufacturability, and other properties (e.g., inertness, water absorption, etc.). In some examples, dielectric element 330-*b* may have a dielectric constant of approximately 2.1. For example, dielectric element 330-*b* may be made out of Polytetrafluoroethylene (PTFE) (also sold under the brand name Teflon by DuPont Co.), or a thermoplastic polymer such as Polymethylpentene (e.g., TPX, a 4-methylpentene-1 based polyolefin manufactured by Mitsui Chemicals)., or thermoplastic polymer such as TPX. In some examples, different portions of the dielectric element 330-*b* may be constructed from different materials. For example, the matching features 525 may be constructed of a first dielectric material having a first dielectric constant while the dielectric member 505 may be constructed from a second dielectric material having a second, different dielectric constant.

Figure 6:
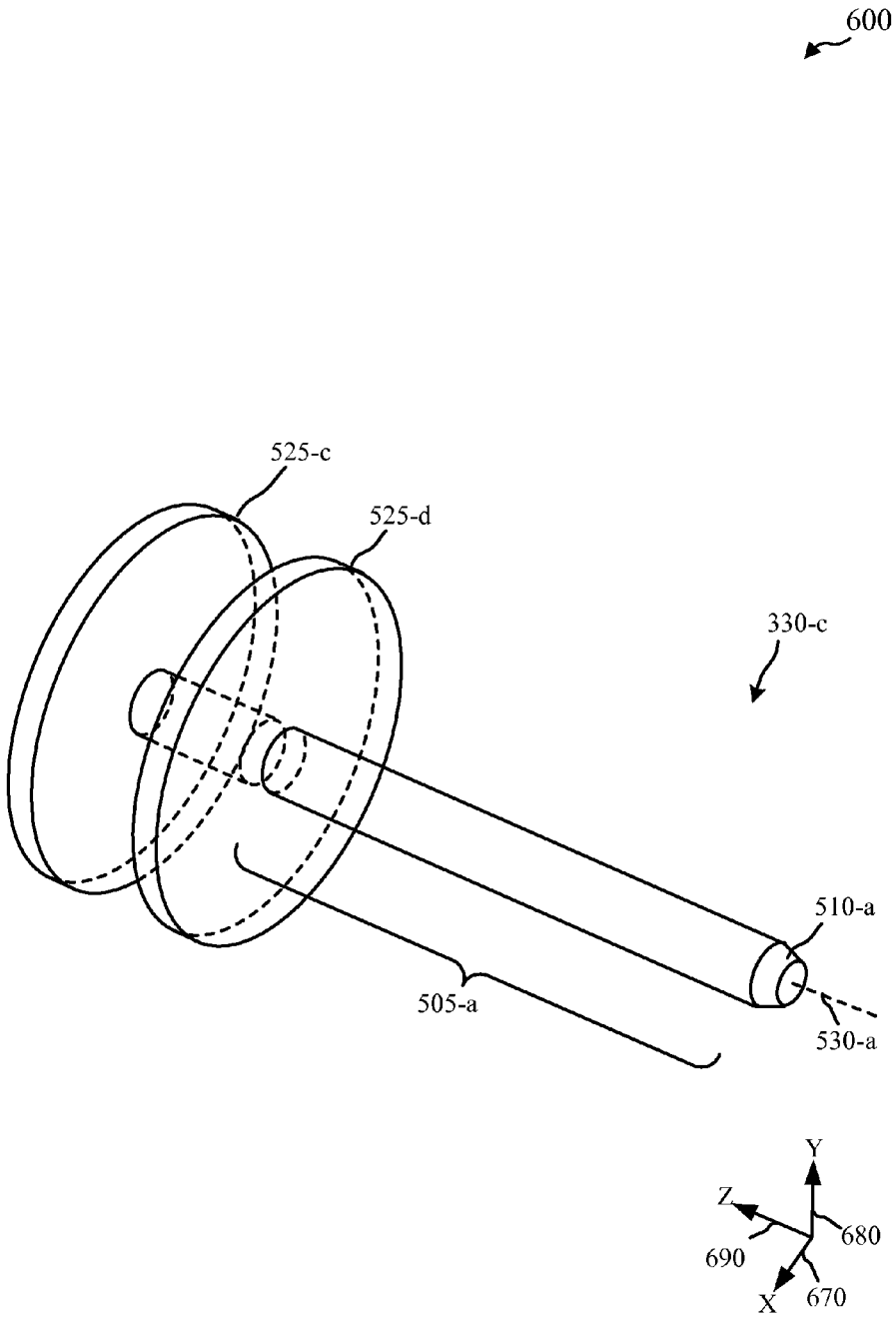
FIG. 6 shows a perspective view of an example dielectric element for a dual-polarized antenna in accordance with various aspects of the present disclosure.

FIG. 6 shows a perspective view 600 of an example dielectric element 330-*c* for a dual-polarized antenna in accordance with various aspects of the present disclosure.

Dielectric element 330-*c* may illustrate, for example, aspects of the dielectric elements 330 of FIGS. 3, and 4A-4C. Dielectric element 330-*c* may be inserted into an individual waveguide 325 of a dual-polarized antenna 140, as discussed above.

Dielectric element 330-*c* may include one or more matching features 525-*c* and 525-*d* with gaps along the Z-axis 690 in-between matching features, which may be similar to the matching features 525-*a* and 525-*b* of dielectric element 330-*b* illustrated in FIGS. 5A and 5B. Thus, although illustrated as circular disks in the transverse plane (e.g., a plane defined by X-axis 670 and Y-axis 680), matching features 525-*c* and/or 525-*d* may have a different shape (e.g., square, etc.).

Dielectric element 330-*c* may include dielectric member 505-*a*, which in the illustrated example is an axial rod extending along axis 530-*a*. When inserted into the individual waveguide 325, axis 530-*a* may be centrally located within the individual waveguide 325. As discussed above, when dielectric element 330-*c* is inserted into a corresponding individual waveguide 325, dielectric member 505-*a* may extend at least partially into the waveguide horn 415. Dielectric member 505-*a* may include a tapered section 510-*a*, which may assist in collecting and distributing energy between the multiple separate signals in the individual waveguides 325 and the waveguide horn 415.

Figure 7A:
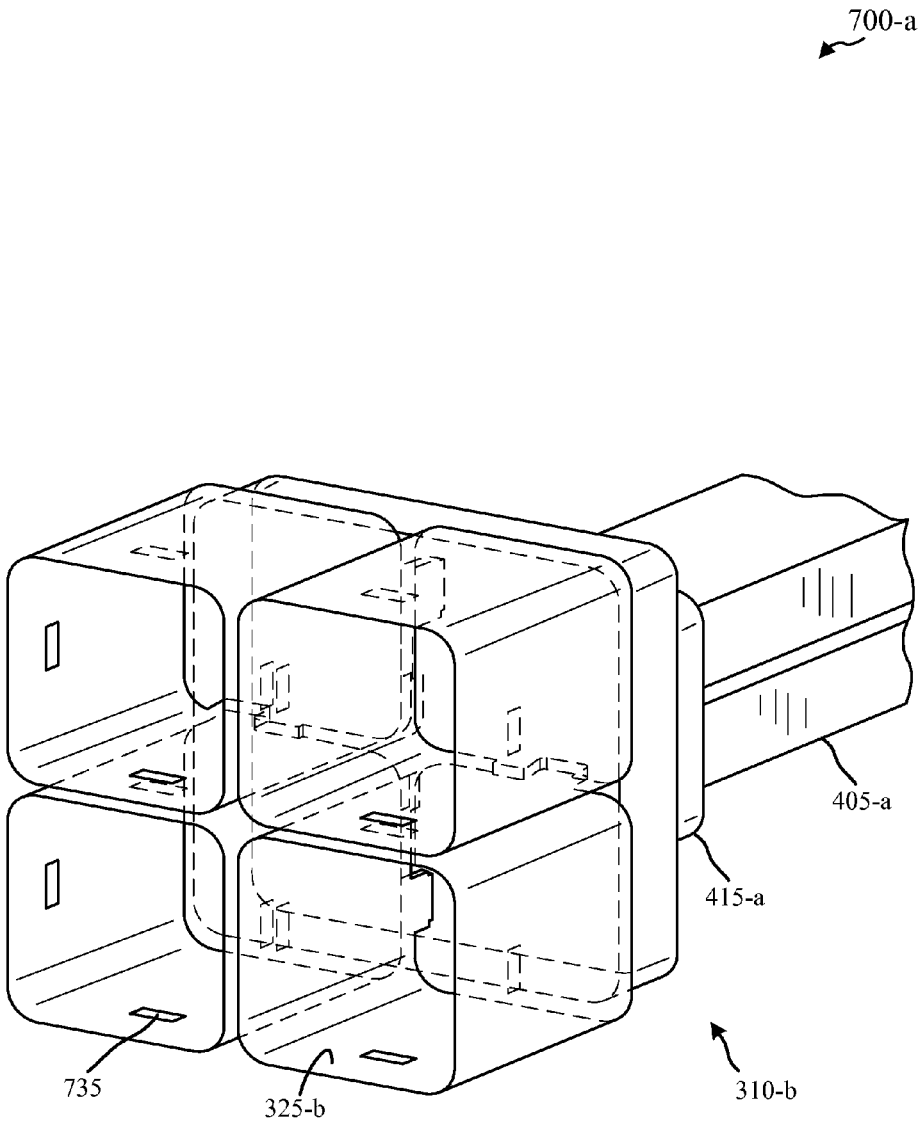
FIGS. 7A and 7B show views of an example unit cell for a dual-polarized antenna in accordance with various aspects of the present disclosure.
Figure 7B:
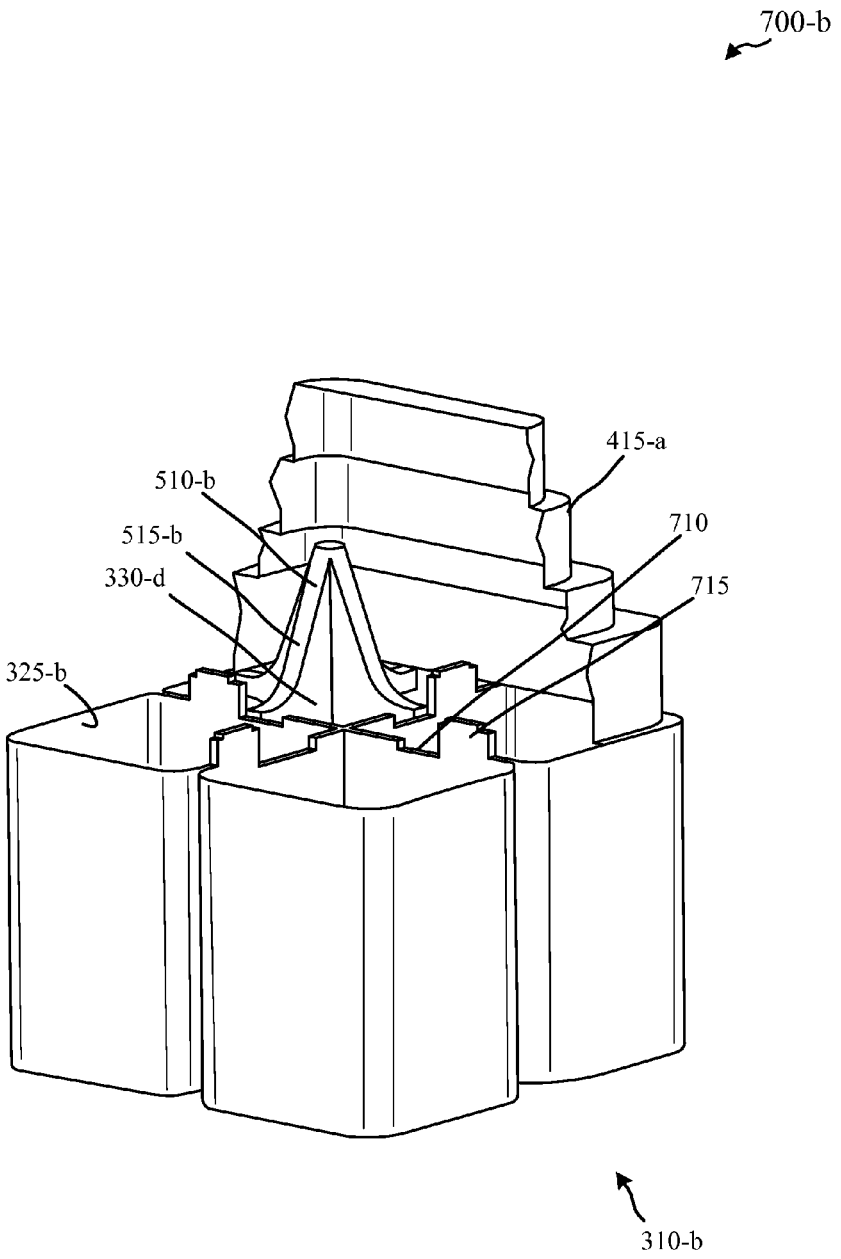

FIGS. 7A and 7B show views of an example unit cell 310-*b* for a dual-polarized antenna in accordance with various aspects of the present disclosure. Unit cell 310-*b* may be an example of unit cells 310 of FIG. 3, 4A, 4B, or 4C. Unit cell 310-*b* includes a polarizer 405-*a* (of which only a portion is illustrated in FIG. 7A), waveguide horn 415-*a*, and multiple individual waveguides 325-*b* (of which only one is labeled for clarity). Unit cell 310-*b* may include multiple dielectric elements 330-*d* (shown only in FIG. 7B), where each dielectric element 330-*d* is inserted into a corresponding individual waveguide 325-*b*. In unit cell 310-*b*, the dielectric elements 330-*d*, as well as waveguide devices of the unit cell 310-*b* may include features for supporting and retaining dielectric elements 330-*d*. In addition, the dielectric elements 330-*d* and waveguide devices of the unit cell 310-*b* may include features for enhancing signal propagation between the individual waveguides 325-*b* and the waveguide horn 415-*a*.

As shown in view 700-*a* of FIG. 7A, each individual waveguide 325-*b* may have retention features 735 (of which only one is labeled for clarity) for mating to corresponding retention features (not shown) of a dielectric element 330-*d*. The retention features 735 may be located along one or more walls of the respective individual waveguide 325-*b*. In some examples, the retention features 735 are holes or recesses in wall(s) of the individual waveguides 325-*b* for mating to a corresponding tab on the dielectric element 330-*d*.

In view 700-*b* of FIG. 7B, waveguide horn 415-*a* is cut away to show features of the dielectric elements 330-*d* and individual waveguides 325-*d* at the interface between the individual waveguides 325-*b* and the waveguide horn 415-*a*. As discussed above, the dielectric element 330-*d* may extend at least partially into the waveguide horn 415-*a*, which may facilitate energy transfer between the waveguide horn 415-*a* and the individual waveguides 325-*b*. The dielectric element 330-*d* may include transverse features 515-*b* (of which only one is labeled for clarity) extending towards each wall of the individual waveguide 325-*b*. The transverse features 515-*b* may include a tapered section 510-*b* which may assist in collecting and distributing energy between the multiple separate signals in the individual waveguides 325-*b* and the common signal in the waveguide horn 415-*a*. The transverse features 515-*b* including tapered section 510-*b* may be tuned to match characteristics of the waveguide horn 415-*a* (e.g., horn taper, steps, etc.) for desired performance.

As shown in FIG. 7B, the individual waveguides 325-*b* may include one or more features along the shared walls of the individual waveguides 325-*b* at the interface between the individual waveguides 325-*b* and the waveguide horn 415-*a*. These features may include portions of the shared walls that extend at least partially into the waveguide horn 415-*a* or portions of the shared walls that are cut away or notched. For example, each shared wall of individual waveguides 325-*b* in FIG. 7B includes a notch element 710 (of which only one is labeled for clarity) and an extension element 715 (of which only one is labeled for clarity). The shape of the notch element 710 or extension element 715 may vary based on the particular application and may be tuned to work in combination with the tapered section 510-*b* of the dielectric elements 330-*d* and shape of the waveguide horn 415-*a* to provide effective energy transfer at the desired operational frequencies.

Figure 8A:
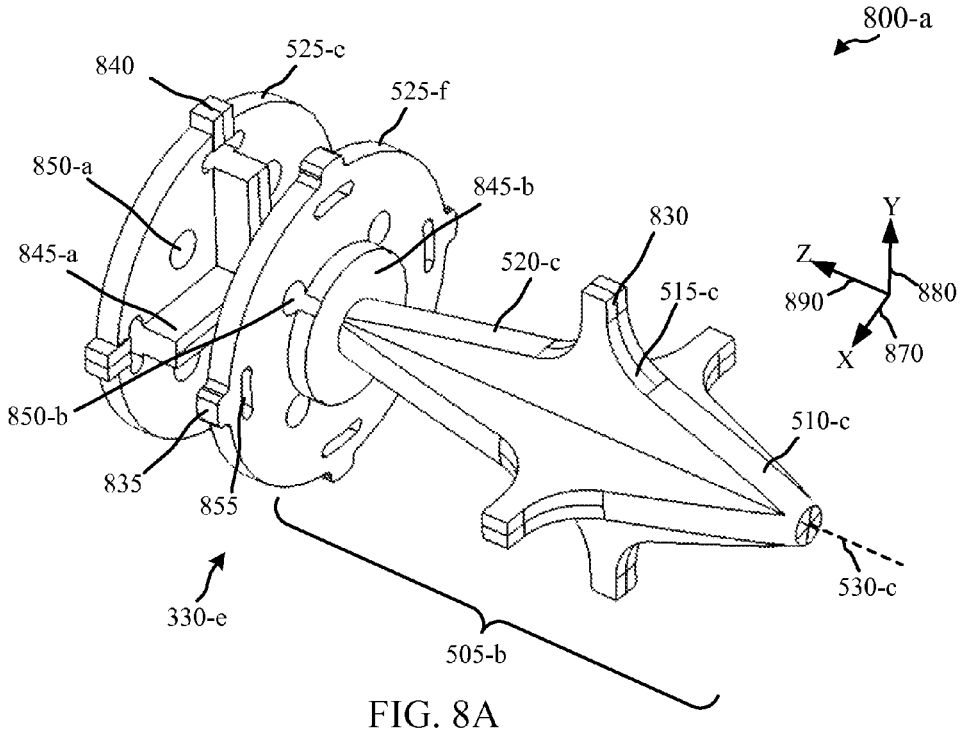
FIGS. 8A-8C show views of dielectric element for a unit cell for a dual-polarized antenna in accordance with various aspects of the present disclosure.
Figure 8B:
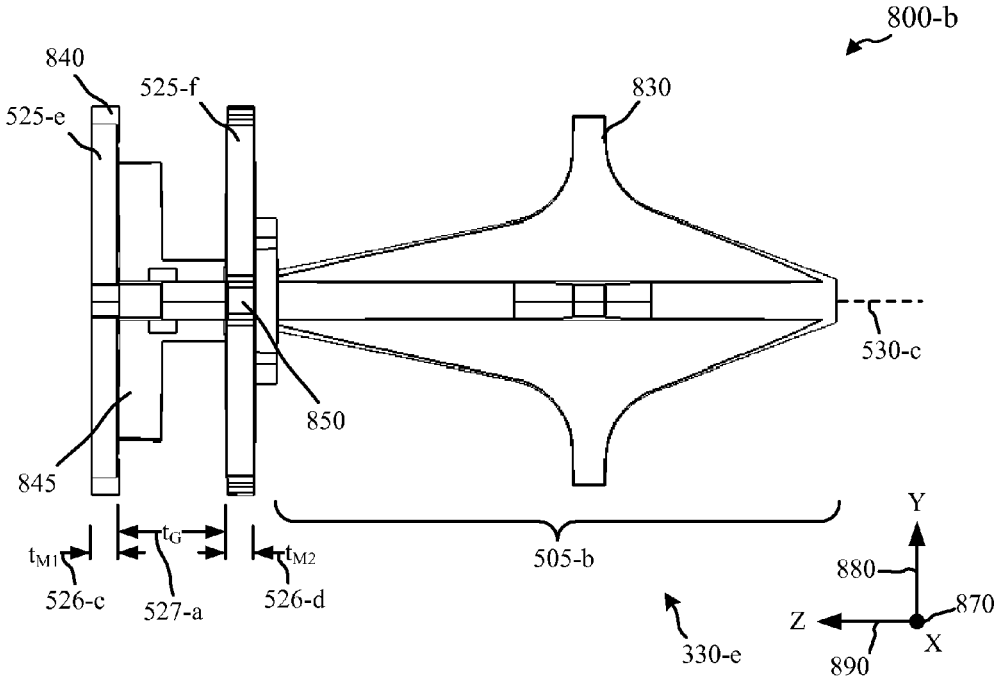
Figure 8C:
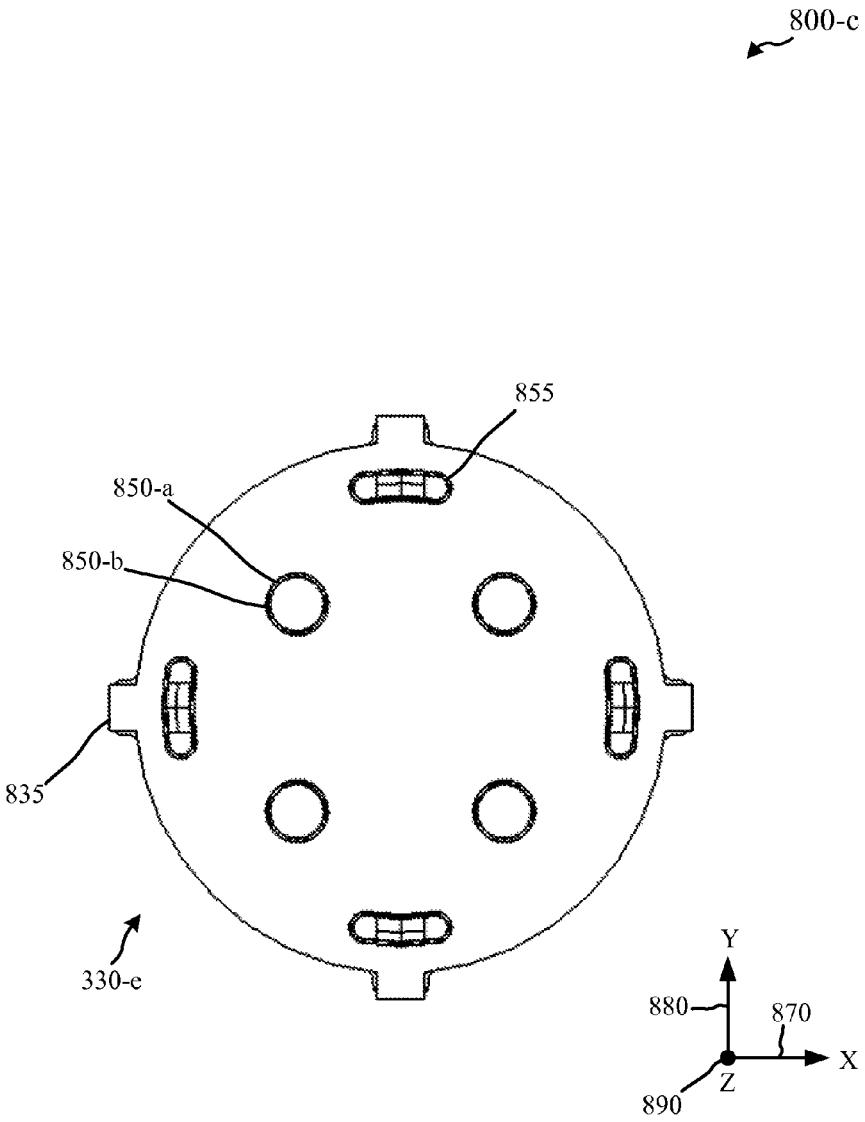

FIGS. 8A-8C show views of dielectric element 330-*e* for a unit cell for a dual-polarized antenna in accordance with various aspects of the present disclosure. Dielectric element 330-*e* may be an example of dielectric elements 330 of FIGS. 3, 4A-4C, 5A, 5B, 6, and 7B. Dielectric element 330-*e* may be inserted into an individual waveguide 325 of a dual-polarized antenna 140, as discussed above.

Dielectric element 330-*e* may include one or more matching features 525, which may improve signal propagation matching between the dielectric loaded individual waveguide 325 of the antenna 140 and free space. As shown in FIGS. 8A-8C, dielectric element 330-*e* includes matching features 525-*e* and 525-*f* that have a circular shape in a transverse plane (e.g., a plane defined by the X-axis 870 and the Y-axis 880). In the axial direction (e.g., along Z-axis 890), matching feature 525-*e* has a thickness $t_{M1}$ 526-*c* and matching feature 525-*f* has a thickness $t_{M2}$ 526-*d*, with a gap in-between matching feature 525-*e* and 525-*f* having a thickness of $t_G$ 527-*a*. The shape and thicknesses $t_{M1}$ 526-*c*, $t_{M2}$ 526-*d* of the matching features 525, as well as the gap thickness $t_G$ 527-*a* may be varied to achieve different performance characteristics of the dual-polarized antenna 140 as may be desirable for a given application or implementation.

Dielectric element 330-*e* may include dielectric member 505-*b*. As discussed above, when dielectric element 330-*e* is inserted into a corresponding individual waveguide 325, dielectric member 505-*b* may extend at least partially into a waveguide horn (e.g., waveguide horns 415 of FIG. 4A-4C, 7A or 7B). Dielectric member 505-*b* may include one or more transverse features 515-*c* (of which only one is labeled for clarity). Transverse features 515-*c* may include a first tapered section 510-*c* that extends into the waveguide horn 415. Transverse features 515-*c* may include a support feature 830, which may contact a surface (e.g., wall) of the individual waveguide 325 when the dielectric element 330-*e* is inserted, as described in more detail below. The transverse features 515-*c* may extend farthest out from a central axis 530-*c* approximately at the interface between the individual waveguide 325 and the waveguide horn 415 when inserted into the individual waveguide 325, and may include a second tapered section 520-*c* towards the matching features 525.

Dielectric element 330-*e* may include one or more retention features 835 (of which only one is labeled for clarity), for mating to corresponding retention features of an individual waveguide 325. The retention features 835 may be a tab for mating to a corresponding hole or recess in a wall of the individual waveguide 325. In some examples, the retention features 835 may be located on one of the matching features 525. The matching features 525 may include relief slots 855 (of which only one is labeled for clarity), which may provide for easier compression of the tab during an insertion process.

Dielectric element 330-*e* may include one or more tooling features 850 for use in handling and insertion of the dielectric element 330-*e* during manufacturing of an antenna. In the example dielectric element 330-*e* illustrated in FIGS. 8A-8C, the tooling features 850 may be holes 850-*a* in the matching feature 525-*e* and holes 850-*b* in the matching feature 525-*f*. In some examples, holes 850-*b* in the matching feature 525-*f* may be the tooling feature used to grasp and position the dielectric element 330-*e*, while the holes 850-*a* in the matching feature 525-*e* allow for access to the holes 850-*b* by the tooling fixture. Thus, the holes 850-*a* may be slightly wider than the holes 850-*b* to allow the tool to be inserted through the holes 850-*a* and contact the holes 850-*b*.

Dielectric element 330-*e* may include other features for manufacturability or structural support. For example, dielectric element 330-*e* includes support features 840, which may contact a front surface of the individual waveguide 325 into which the dielectric element 330-*e* is inserted. As illustrated in FIGS. 8A-8C, dielectric element 330-*e* includes support feature 845-*a* providing structural support to matching feature 525-*e*, and support feature 845-*b* providing structural support to matching feature 525-*f*. As illustrated, support features 845 for matching features 525 may be of various shapes including circular as shown in support feature 845-*b* or having one or more support members as shown in support feature 845-*a*.

FIGS. 9A-9G show views of a dual-polarized antenna 140-*c* in accordance with various aspects of the present disclosure. The dual-polarized antenna 140-*c* may illustrate aspects of the dual-polarized antennas 140 of FIG. 1, 2 or 3.

Figure 9A:
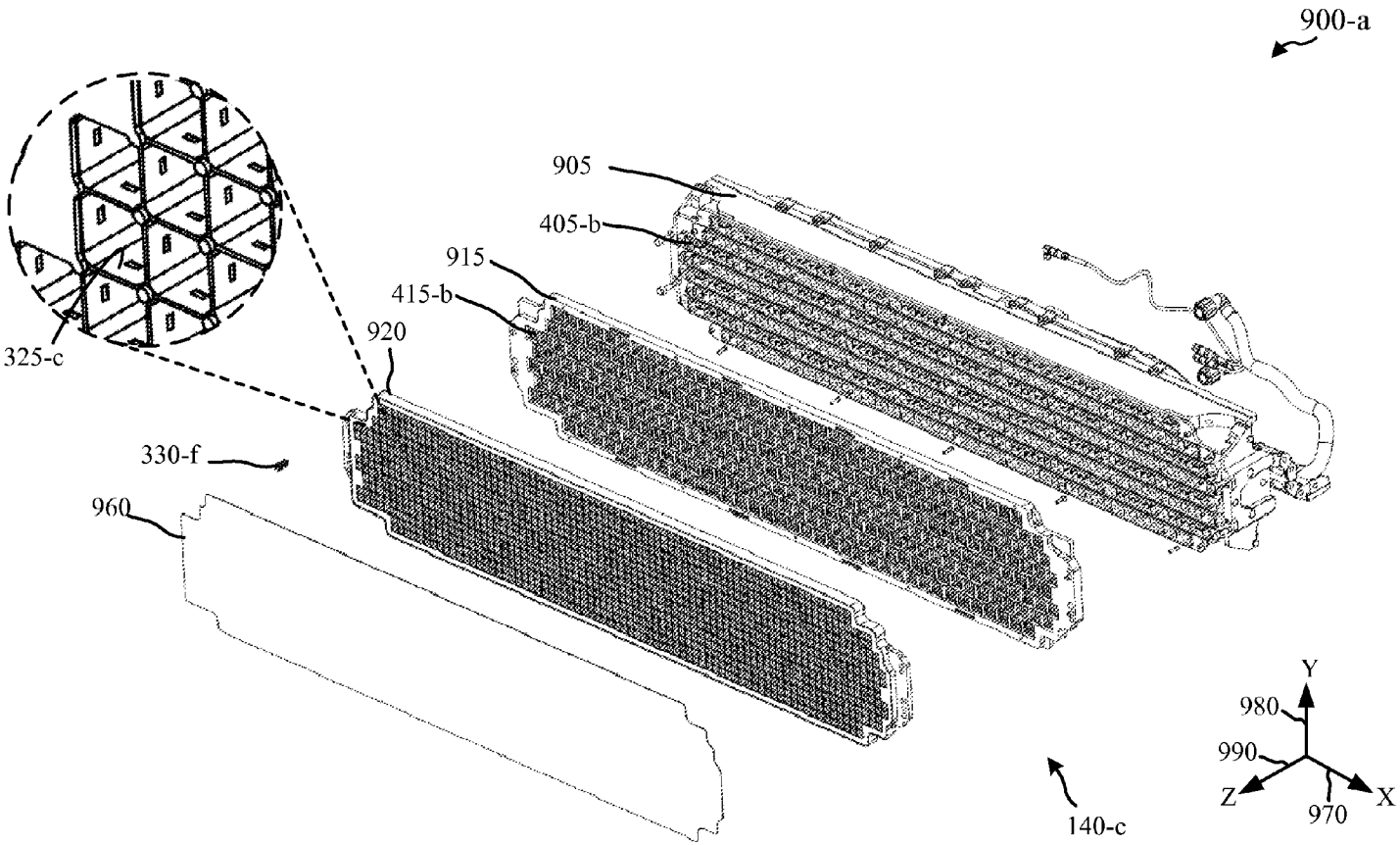
FIGS. 9A-9G show views of a dual polarized antenna in accordance with various aspects of the present disclosure.

As illustrated in exploded view 900-*a* of FIG. 9A, dual-polarized antenna 140-*c* may be constructed of various components to form a dual-polarized waveguide beamforming network. The various components of the antenna 140-*c* may include individual waveguides 325-*c* (of which only one is labeled for clarity), dielectric elements 330-*f* (of which only one is shown for clarity), waveguide horns 415-*b* (of which only one is labeled for clarity), and polarizers 405-*b* (of which only one is labeled for clarity), which may be examples of the individual waveguides 325, dielectric elements 330, waveguide horns 415, and polarizers 405 of FIG. 3, 4A-4C, 7A or 7B, respectively.

Dual-polarized antenna 140-*c* may have a cover layer 960, which may be a suitable material for keeping dust and other particles out of the waveguide devices of dual-polarized antenna 140-*c* while not adversely impacting the electrical properties of waves transmitted and received by dual-polarized antenna 140-*c*. In some examples, cover layer 960 is approximately 10 thousandths (0.010) of an inch thick and is made from a material having a dielectric constant in the range of 2.0-2.2. In one example, cover layer 960 is made from a low loss woven glass PTFE resin. The cover layer 960 may be adhesively bonded to the antenna aperture and to individual dielectric elements 330 using a low surface energy acrylic pressure sensitive adhesive manufactured by 3M.

Dual-polarized antenna 140-*c* may be formed using multiple planar assemblies including an individual waveguide planar assembly 920, a waveguide horn planar assembly 915, and a polarizer beam forming network assembly 905. The individual waveguide planar assembly 920 may be a single workpiece including each individual waveguide 325-*c*. In some examples, the individual waveguide planar assembly 920 is a machined aluminum layer. The waveguide horn planar assembly 915 includes waveguide horns 415-*b*, where each waveguide horn 415-*b* is coupled with multiple individual waveguides 325-*c*. The waveguide horn planar assembly 915 may be a single workpiece (e.g., a machined aluminum layer).

The polarizer beam forming network assembly 905 may include polarizers 405-*b* (only one being labeled for clarity), where the common waveguide for each polarizer 405-*b* is coupled with one waveguide horn 415-*b* of the waveguide planar assembly 920. As discussed above, each polarizer 405-*b* may include first and second divided waveguides associated with first and second basis polarizations. The polarizer beam forming network assembly 905 may also include waveguide combiner/divider networks connecting the divided waveguides for the polarizers 405-*b* with waveguide ports for transmitting and/or receiving signals via the dual-polarized antenna 140-*c*.

The polarizer beam forming network assembly 905 may be formed of multiple layers, where the layers may be perpendicular to the waveguide planar assembly 920 and waveguide horn planar assembly 915. For example, each layer of the polarizer beam forming network assembly 905 may have top and bottom surfaces in a plane defined by X-axis 970 and Z axis 990 and include recesses in the top surface, the bottom surface, or both surfaces that define portions of the polarizers 405-*b* and waveguide combiner/divider networks associated with each basis polarization. In some examples, the layers of polarizer beam forming network assembly 905 are machined aluminum waveguide sub-assemblies having surfaces in a plane defined by X-axis 970 and Z-axis 990 and are stacked in the Y-axis 980. The machined waveguide sub-assemblies may be vacuum brazed together to form the polarizer beam forming network assembly 905.

Thus, dual-polarized antenna 140-*c* may include partially dielectric loaded divided horn waveguide devices (e.g., unit cells 310 of FIG. 3, 4A-4C, 7A or 7B). As described above, each unit cell 310 may include multiple individual waveguides 325-*c* coupled with the common waveguide of a shared polarizer 405-*b* (e.g., septum polarizer) via a waveguide horn 415-*b* and each individual waveguide 325-*c* includes a dielectric element 330-*f* at least partially filling the individual waveguide 325-*c*.

Figure 9B:
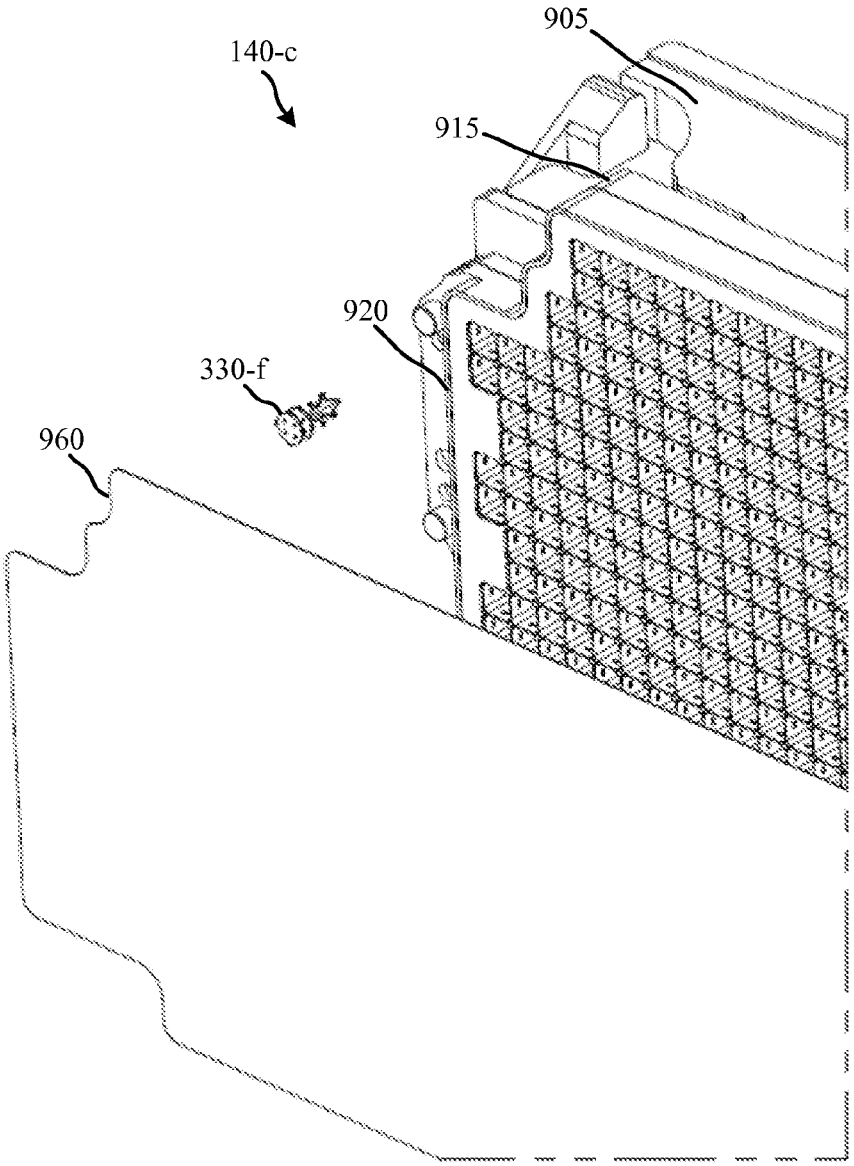

FIG. 9B shows an alternative exploded view 900-*b* of dual-polarized antenna 140-*c*. As shown in FIG. 9B, the waveguide planar assembly 920, waveguide horn planar assembly 915, and polarizer beam forming network assembly 905 may be assembled (e.g., vacuum brazed together, etc.) and the dielectric elements 330-*f* may be inserted into the corresponding individual waveguides 325-*c*.

In some examples, the dielectric elements 330-*f* may be inserted into the individual waveguides 325-*c* using a robotic assembly such as an industrial robotic arm. The dielectric elements 330-*f* may be inserted at an angle (e.g., 45-degrees) and retention features of the dielectric elements 330-*f* may mate with corresponding retention features of the individual waveguides 325-*c* when the dielectric element 330-*f* is rotated.

Figure 9C:
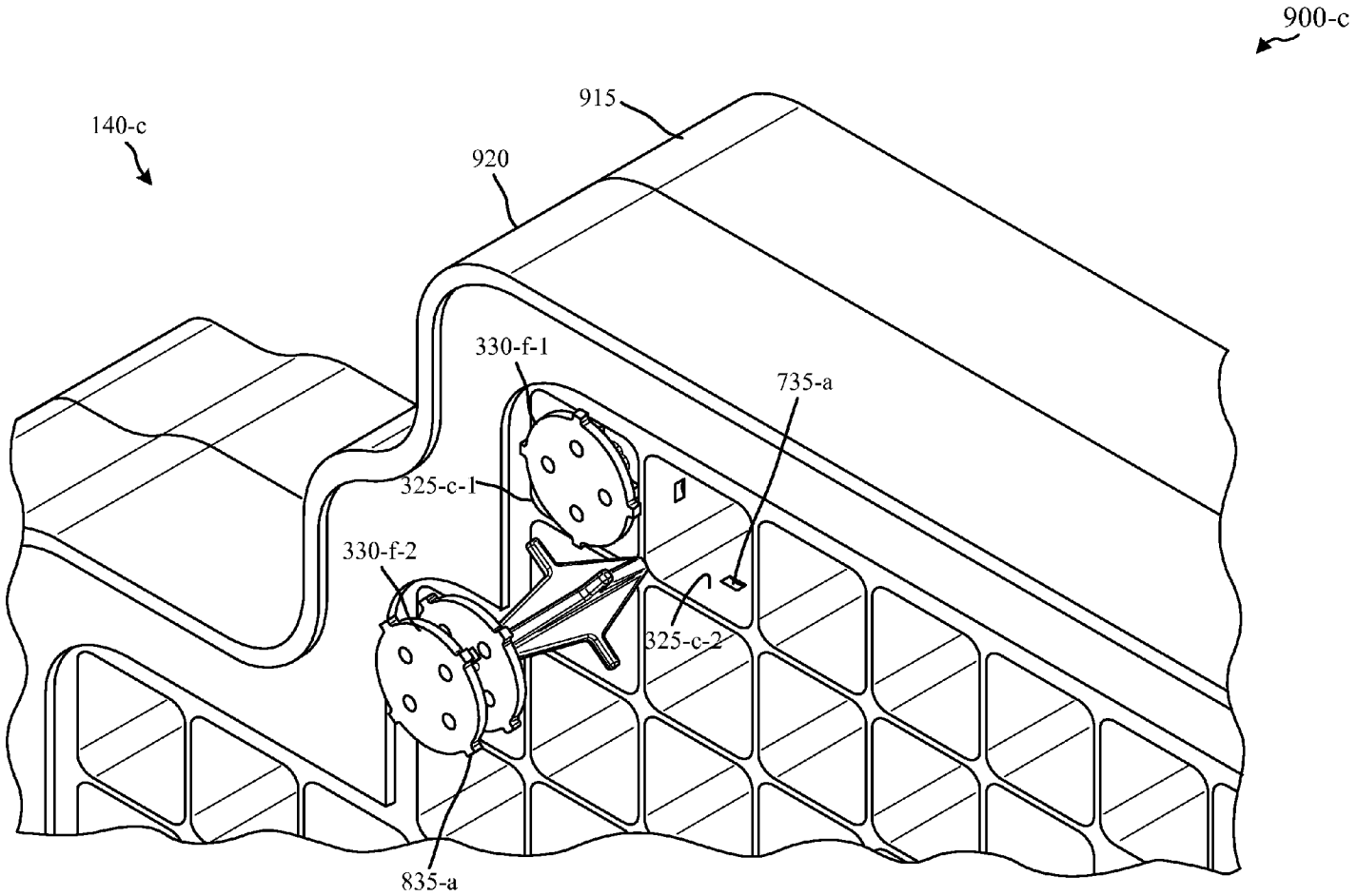

FIG. 9C shows an alternative view 900-*c* of portions of dual-polarized antenna 140-*c*. In view 900-*c*, dielectric element 330-*f*-1 has been inserted into individual waveguide 325-*c*-1 and rotated into a locked position. Dielectric element 330-*f*-2 is being inserted into individual waveguide 325-*c*-2 at a 45 degree angle, where rotation of the dielectric element 330-*f*-2 by 45 degrees once inserted will engage retention features 835-*a* (only one being labeled for clarity) on the dielectric element 330-*f*-2 with the corresponding retention features 735-*a* (only one being labeled for clarity) on individual waveguide 325-*c*-2. Although not illustrated, other individual waveguides 325-*c* may also have retention features 735-*a* for mating with respective retention features 835-*a* of dielectric elements 330-*f*.

Figure 9D:
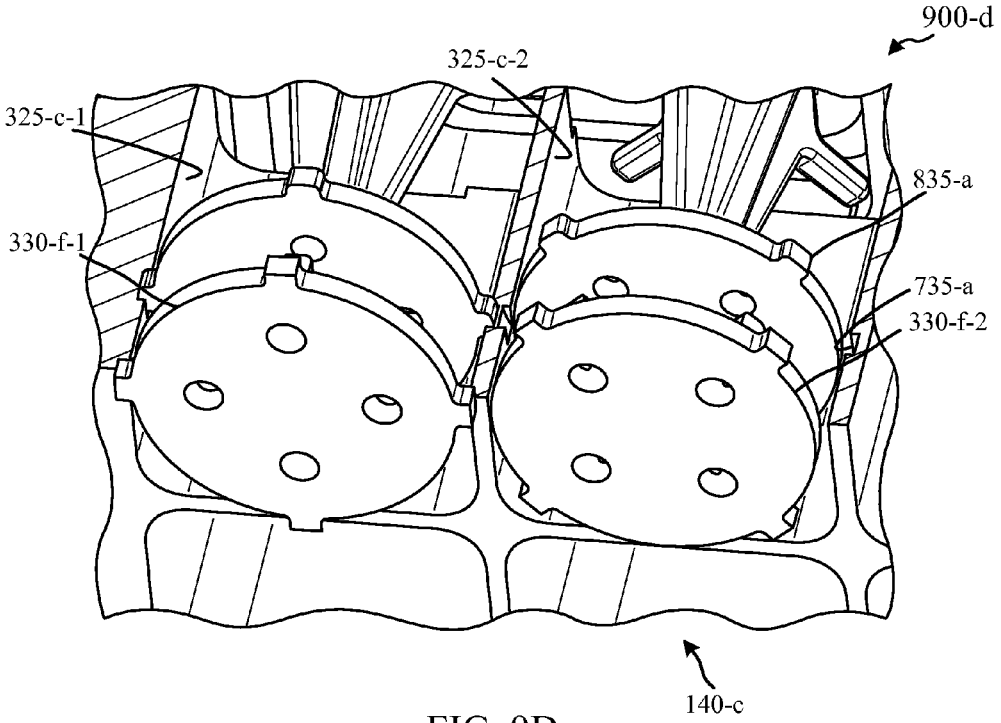

FIG. 9D shows a view 900-*d* of portions of dual-polarized antenna 140-*c*. In view 900-*d*, dielectric element 330-*f*-2 is inserted into individual waveguide 325-*c*-2 at a 45 degree angle to a depth where retention features 835-*a* (only one being labeled for clarity) line up with corresponding retention features 735-*a* (only one being labeled for clarity) on individual waveguide 325-*c*-2.

Figure 9E:
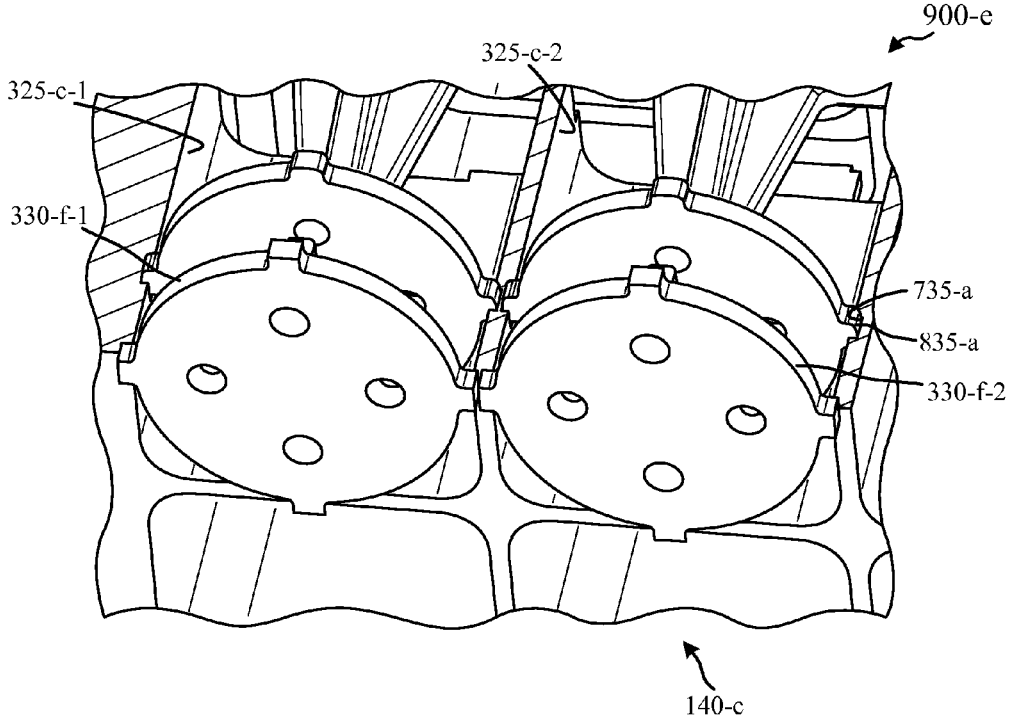

FIG. 9E shows a view 900-*e* of portions of dual-polarized antenna 140-*c*. In view 900-*e*, dielectric element 330-*f*-2 has been rotated 45 degrees from its position in view 900-*d* such that retention features 835-*a* (only one being labeled for clarity) on the dielectric element 330-*f*-2 have engaged with the corresponding retention features 735-*a* (only one being labeled for clarity) on individual waveguide 325-*c*-2.

Figure 9F:
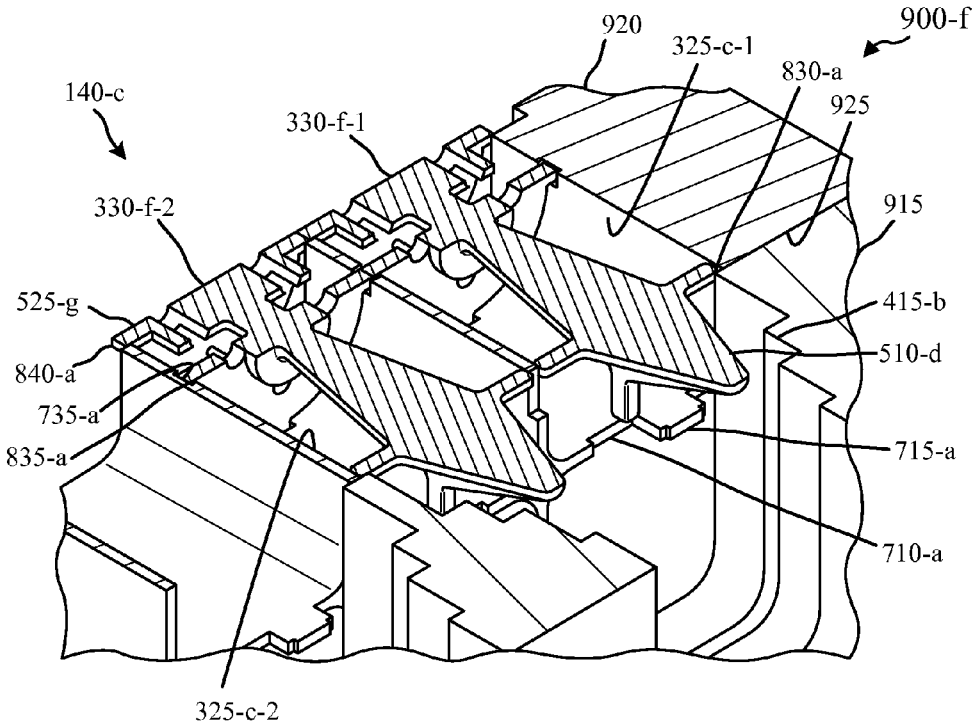
Figure 9G:
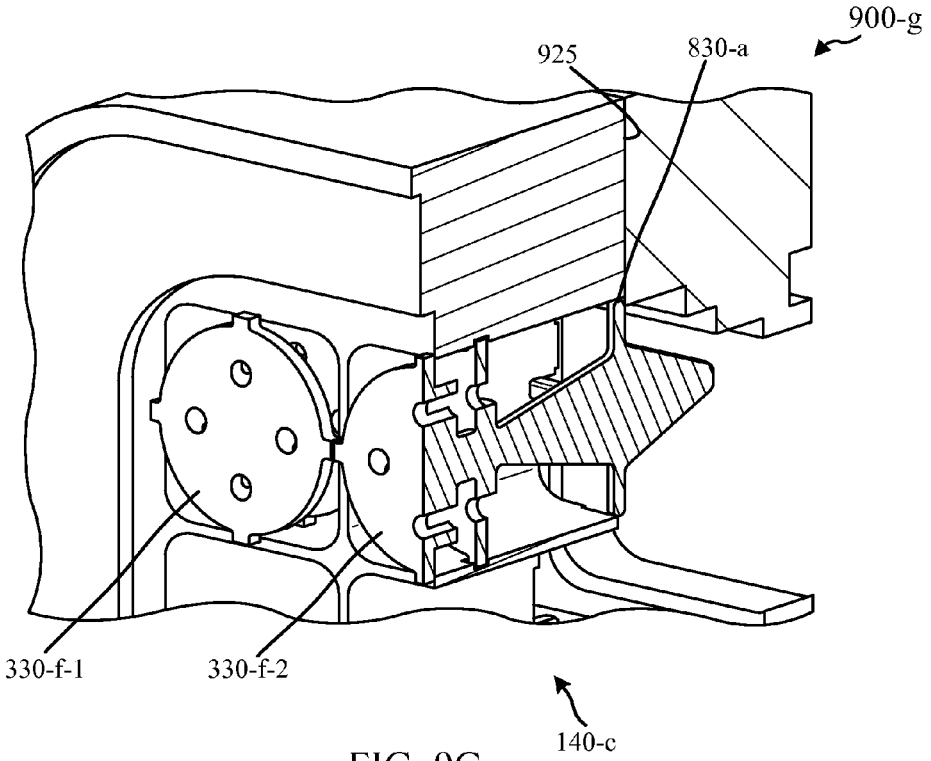

FIGS. 9F and 9G shows cross-sectional views of portions of dual-polarized antenna 140-*c*. Similarly to FIG. 9E, views 900-*f* and 900-*g* of FIGS. 9F and 9G, respectively, illustrate cross-sectional views of the individual waveguides 325-*c* and dielectric elements 330-*f* showing retention features 835-*a* (only one being labeled for clarity) on the dielectric element 330-*f*-2 engaged with the corresponding retention features 735-*a* (only one being labeled for clarity) on individual waveguide 325-*c*-2. In addition, it can be seen in view 900-*f* that support features 830-*a* (only one being labeled for clarity) are in contact with walls of the individual waveguides 325-*c* to provide support for dielectric elements 330-*f*. As is also shown in FIGS. 9F and 9G, the waveguide horn 415-*b* may have a smaller cross-sectional width at the interface to the individual waveguides 325-*c* than the 2-by-2 array of individual waveguides 325-*c*. Thus, support features 830-*a* may also contact the step at the transition between the waveguide horn 415-*b* and the individual waveguides 325-*c*. As shown in FIG. 9F, support features 830-*a* contact waveguide horn planar assembly 915 at the interface 925 of the individual waveguides 325-*c* and waveguide horn 415-*b*.

As described above, dielectric elements 330-*f* may also include support features 840-*a* (only one being labeled for clarity), which may be extensions of front matching feature 525-*g*. As shown in FIG. 9F, support features 840-*a* may contact the front of waveguide planar assembly 920 when dielectric elements 330-*f* are inserted into the individual waveguides 325-*c*.

FIG. 9F also shows notch element 710-*a* and extension element 715-*a* (of which only one is labeled for clarity) on the shared walls between individual waveguides 325-*c*. As is shown in FIG. 9F, notch element 710-*a* may be a recess in waveguide planar assembly 920 (e.g., compared to interface 925 between waveguide planar assembly 920 and waveguide horn planar assembly 915), while extension element 715-*a* may extend beyond interface 925 and partially into waveguide horn 415-*b*. The shape of the notch element 710-*a* and/or extension element 715-*a* may vary based on the particular application and these features may be tuned to work in combination with features of the dielectric elements 330-*f* and shape of the waveguide horn 415-*b* to provide effective energy transfer at the desired operational frequencies.

Figure 10:
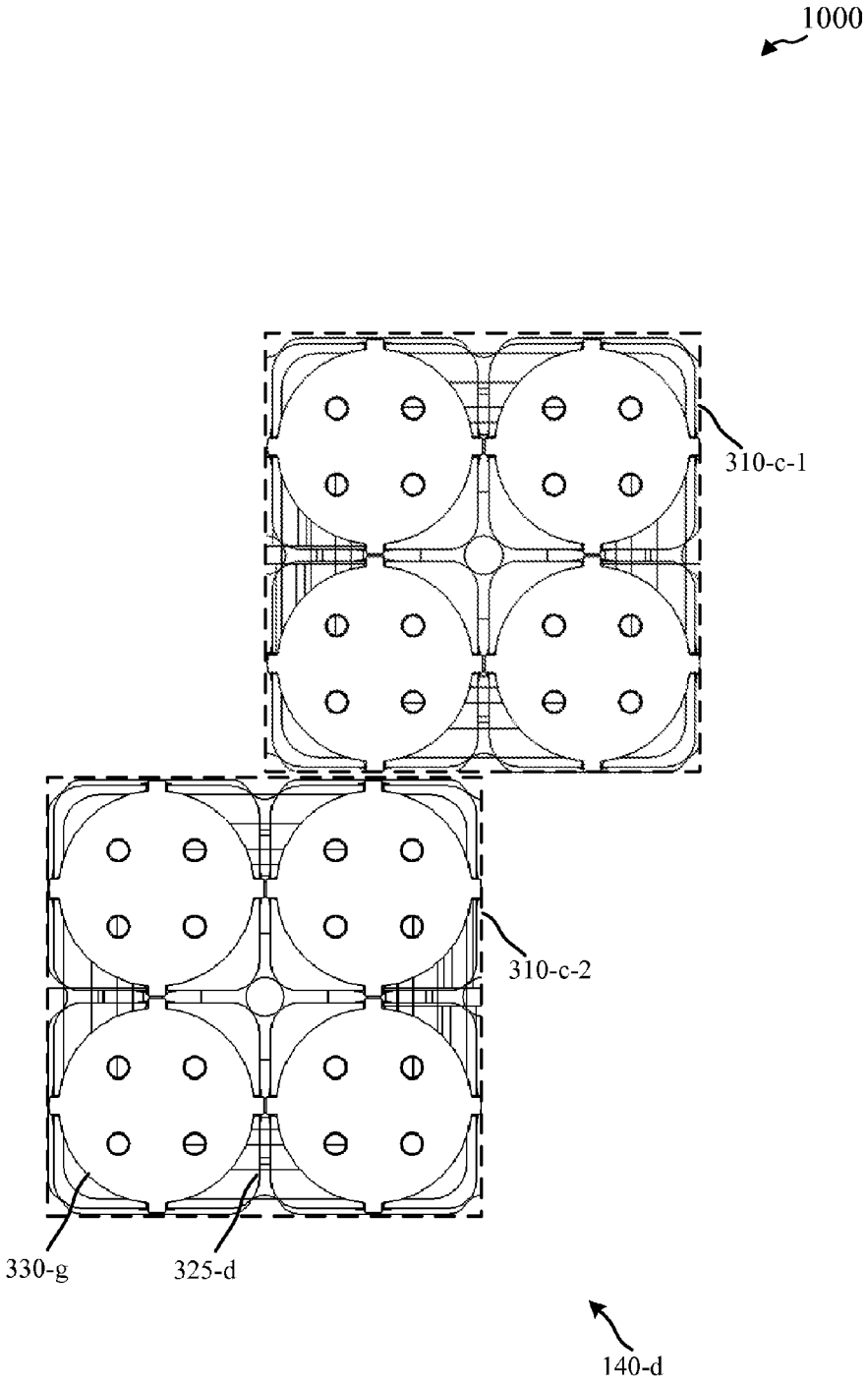
FIG. 10 shows a front view of a dual-polarized antenna in accordance with various aspects of the present disclosure.

FIG. 10 shows a front view 1000 of a dual-polarized antenna 140-*d* in accordance with various aspects of the present disclosure. Dual-polarized antenna 140-*d* may be an example of dual-polarized antennas 140 of FIG. 1, 2, 3 or 9A-9G. Front view 1000 shows two unit cells 310-*c*-1 and 310-*c*-2 of dual-polarized antenna 140-*d*. Although not pictured in FIG. 10, it should be understood that dual-polarized antenna 140-*d* can include additional unit cells 310-*c*. As illustrated in FIG. 10, each unit cell 310-*c* includes a 2 by 2 array of individual waveguides 325-*d* (of which only one is labeled for clarity), each having a dielectric element 330-*g* inserted (of which only one is labeled for clarity).

As seen in front view 1000 of antenna 140-*d*, the second unit cell 310-*c*-2 is offset from the first unit cell 310-*c*-1 such that a left-most column of the 2 by 2 array of the second unit cell 310-*c*-2 is aligned with a right-most column of the 2 by 2 array of the first unit cell 310-*c*-1. Thus, unit cells 310-*c* may be arranged such that adjacent rows of unit cells 310-*c* may be offset by one column of individual waveguides 325-*d*. Alternatively, unit cells 310-*c* may be arranged such that adjacent columns of unit cells 310-*c* may be offset by one row of individual waveguides 325-*d*. For example, a top-most row of the 2 by 2 array of the second unit cell 310-*c*-2 may be aligned with a bottom-most row of the 2 by 2 array of the first unit cell 310-*c*-1.

Figure 11:
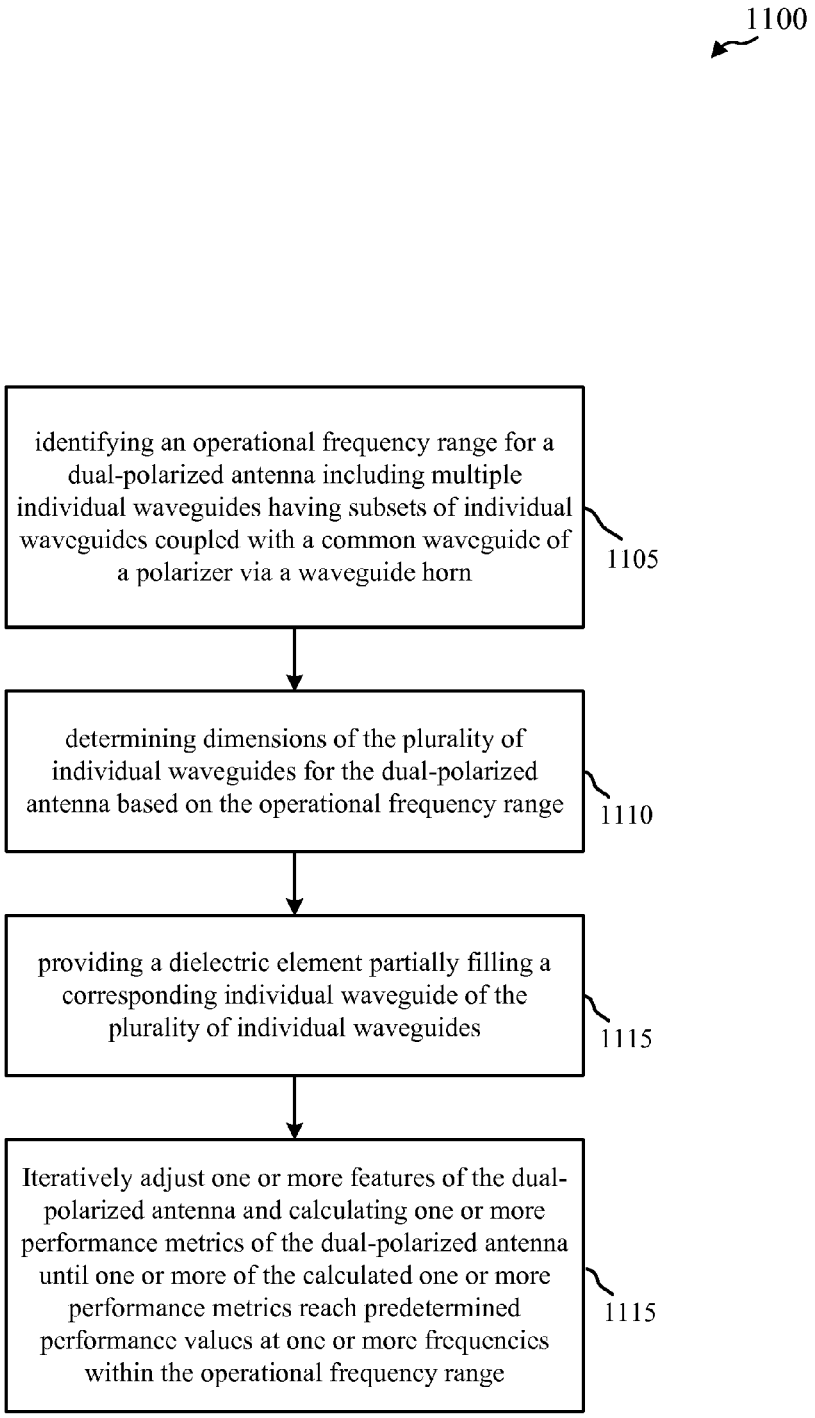
FIG. 11 shows a method for designing a partially dielectric loaded dual-polarized antenna in accordance with various aspects of the present disclosure.

FIG. 11 shows a method 1100 for designing a partially dielectric loaded dual-polarized antenna in accordance with various aspects of the present disclosure. The method 1100 may be used, for example, to design a partially dielectric loaded dual-polarized antenna with a desired operational frequency range. The method 1100 may be used to iteratively select size and shape of various components of partially dielectric loaded divided horn waveguide devices of the dual-polarized antenna including individual waveguides 325, waveguide horns 415, polarizers 405, and dielectric elements 330 as discussed above.

Method 1100 may begin at block 1105 where an operational frequency range for the dual-polarized antenna may be identified. The dual-polarized antenna may include multiple individual waveguides (e.g., in an array), and a subset of the individual waveguides may be coupled with a common waveguide of a polarizer via a waveguide horn having a transition section of increasing waveguide cross-sectional size from the common waveguide to the subset of individual waveguides. For example, the dual-polarized antenna may include multiple unit cells 310 as described above with reference to FIGS. 3, 4A-4C, 7A, 7B and 9A-9G.

At block 1110, dimensions of the individual waveguides for the dual-polarized antenna may be determined based on the operational frequency range. The dimensions of the individual waveguides (e.g., inter-element distance, individual waveguide width and height, etc.) determined at block 1110 may be nominal dimensions determined assuming no dielectric loading, in some cases. The operational frequency range may include, for example, a plurality of discontinuous frequency segments.

At block 1115, a dielectric element partially filling a corresponding individual waveguide of the multiple individual waveguides may be provided. The dielectric element may have a dielectric member (e.g., axial rod, axial element with transverse features, etc.) extending along the corresponding individual waveguide and one or more matching features for matching signal propagation between the corresponding individual waveguide loaded by the dielectric element and free space.

At block 1120 one or more features of the components of the dual-polarized antenna may be iteratively adjusted and one or more performance metrics of the dual-polarized antenna may be calculated until one or more of the calculated one or more performance metrics reach predetermined performance values at one or more frequencies within the operational frequency range. For example, the one or more performance metrics may be calculated at each of a plurality of frequencies within the operational frequency range, and the one or more features of the components of the dual-polarized antenna may be adjusted until the one or more of the calculated one or more performance metrics reach the predetermined performance values at each of the plurality of frequencies. The performance metrics calculated at block 1120 may include a gain, a realized gain, a directivity, a cross-polarization, a reflection coefficient, an isolation value between divided waveguide ports, or antenna pattern sidelobes of the dual-polarized antenna.

Adjusting one or more features of the components of the dual-polarized antenna at block 1120 may include adjusting one or more features of the dielectric elements 330 such as matching features 525, the dielectric member 505, transverse features 515, first tapered section 510, or second tapered section 520 described above with reference to FIG. 5A-5B, 6, or 8A-8C. Additionally or alternatively, adjusting one or more features of the components of the dual-polarized antenna may include adjusting one or more features of the individual waveguides 325 or waveguide horn 415. For example, the dimensions (e.g., cross-sectional width, depth, etc.) of the individual waveguides may be adjusted, or features of the individual waveguides such as notch features 710 and extension features 715 at the interface between the waveguide horn 415 and individual waveguides 325 may be adjusted. Additionally or alternatively, the shape and dimensions of the waveguide horn 415 may be adjusted including a horn shape (e.g., stepped, tapered, etc.), horn dimensions, or number of steps.

Figure 12:
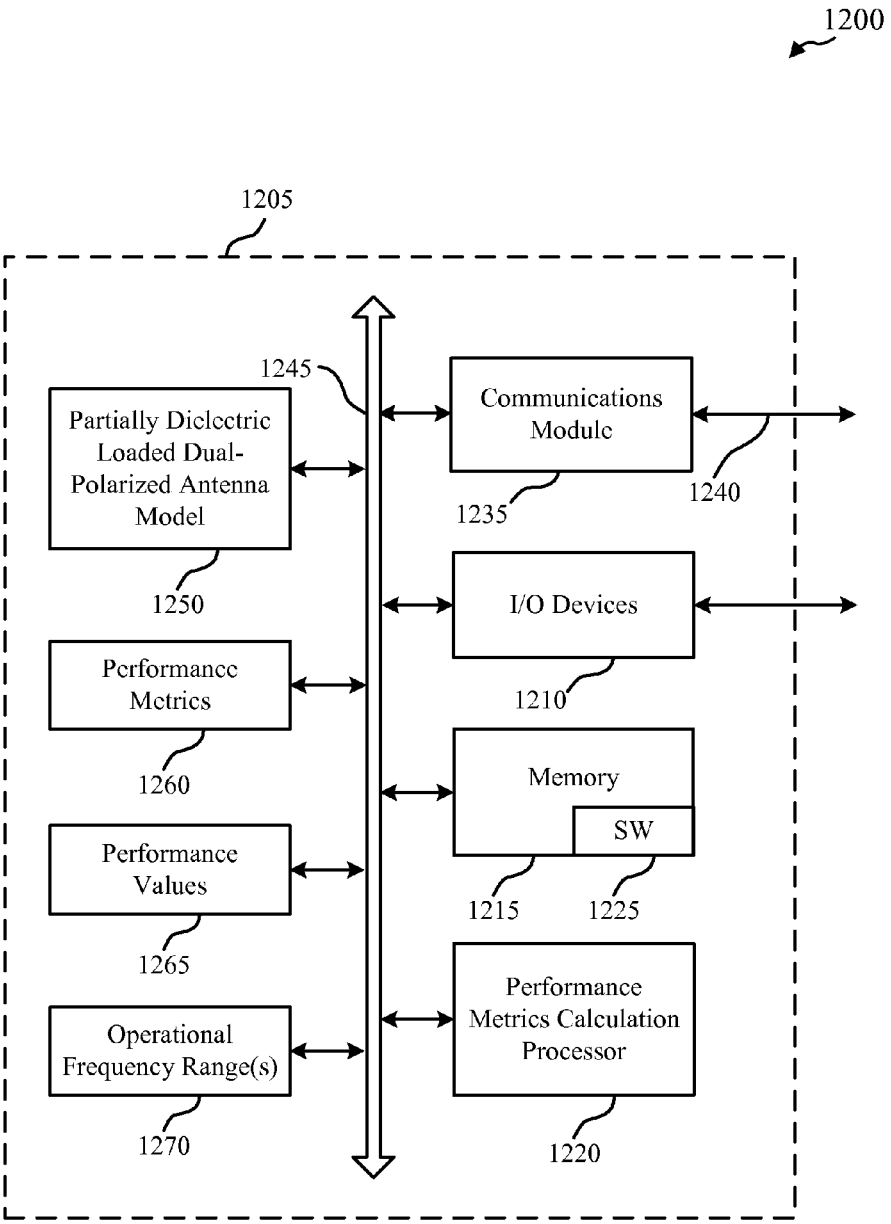
FIG. 12 shows a diagram of a design environment for designing a partially dielectric loaded dual-polarized antenna in accordance with various aspects of the present disclosure.

FIG. 12 shows a diagram 1200 of a design environment 1205 for designing a partially dielectric loaded dual-polarized antenna in accordance with various aspects of the present disclosure. The design environment 1205 includes performance metrics calculation processor 1220, memory 1215, I/O devices 1210, and communications module 1235, which each may be in communication, directly or indirectly, with each other, for example, via one or more buses 1245. The communications module 1235 may be configured to communicate bi-directionally via one or more wired or wireless links 1240.

The design environment 1205 includes partially dielectric loaded dual-polarized antenna model 1250, which may include one or more partially dielectric loaded divided horn waveguide devices (e.g., unit cells 310 as described with reference to FIG. 3, 4A-4C, 7A or 7B). Each partially dielectric loaded divided horn waveguide device may include multiple individual waveguides coupled with the common waveguide of a shared polarizer (e.g., septum polarizer) via a waveguide horn where each individual waveguide includes a dielectric element at least partially filling the individual waveguide. The dimensions of the individual waveguides may be nominal dimensions determined for an operational frequency range(s) 1270 assuming no dielectric loading, in some cases.

Performance metrics calculation processor 1220 may calculate one or more performance metrics 1260 for the partially dielectric loaded dual-polarized antenna model 1250. For example, performance metrics calculation processor 1220 may calculate the one or more performance metrics 1260 at each of a plurality of frequencies within predetermined operational frequency range(s) 1270. The calculated one or more performance metrics may then be compared to predetermined performance values 1265, and input may be received for adjusting one or more features of the partially dielectric loaded dual-polarized antenna model 1250. The calculation of the one or more performance metrics 1260 and adjusting the one or more features of the partially dielectric loaded dual-polarized antenna model 1250 may be iteratively performed until the calculated one or more performance metrics 1260 reach the predetermined performance values 1265 at each of the plurality of frequencies of the predetermined operational frequency range(s) 1270.

The performance metrics 1260 may include a gain, a realized gain, a directivity, a cross-polarization, or antenna pattern sidelobes of the partially dielectric loaded dual-polarized antenna model 1250. The adjusting one or more features of the partially dielectric loaded dual-polarized antenna model 1250 may include adjusting one or more features of the dielectric elements 330, the individual waveguides 325, or waveguide horn 415 as described above with reference to FIG. 3, 4A-4C, 5A, 5B, 6, 7A, 7B, 6, or 9A-9C.

The memory 1215 may include random access memory (RAM) and read only memory (ROM). The memory 1215 may store computer-readable, computer-executable software/firmware code 1225 including instructions that are configured to, when executed, cause the performance metrics calculation processor 1220 to perform various functions described herein (e.g., calculating one or more performance metrics of the partially dielectric loaded dual-polarized antenna model 1250, etc.). Alternatively, the software/firmware code 1225 may not be directly executable by the performance metrics calculation processor 1220 but be configured to cause a computer (e.g., when compiled and executed) to perform functions described herein. The performance metrics calculation processor 1220 may include an intelligent hardware device, e.g., a central processing unit (CPU), a microcontroller, an ASIC, etc. may include RAM and ROM.

The detailed description set forth above in connection with the appended drawings describes exemplary embodiments and does not represent the only embodiments that may be implemented or that are within the scope of the claims. The term "example" used throughout this description means "serving as an example, instance, or illustration," and not "preferred" or "advantageous over other embodiments." The detailed description includes specific details for the purpose of providing an understanding of the described techniques. These techniques, however, may be practiced without these specific details. In some instances, well-known structures and devices are shown in block diagram form in order to avoid obscuring the concepts of the described embodiments.

Information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The components and functions described herein may be implemented in various ways, with different materials, features, shapes, sizes, or the like. Other examples and implementations are within the scope of the disclosure and appended claims. Features implementing functions may also be physically located at various positions, including being distributed such that portions of functions are implemented at different physical locations. Also, as used herein, including in the claims, "or" as used in a list of items (for example, a list of items prefaced by a phrase such as "at least one of" or "one or more of") indicates a disjunctive list such that, for example, a list of "at least one of A, B, or C" means A or B or C or AB or AC or BC or ABC (i.e., A and B and C).

As used in the present disclosure, the term "parallel" is not intended to suggest a limitation to precise geometric parallelism. For instance, the term "parallel" as used in the present disclosure is intended to include typical deviations from geometric parallelism relating to such considerations as, for example, manufacturing and assembly tolerances. Furthermore, certain manufacturing process such as molding or casting may require positive or negative drafting, edge chamfers and/or fillets, or other features to facilitate any of the manufacturing, assembly, or operation of various components, in which case certain surfaces may not be geometrically parallel, but may be parallel in the context of the present disclosure.

Similarly, as used in the present disclosure, the terms "orthogonal" and "perpendicular", when used to describe geometric relationships, are not intended to suggest a limitation to precise geometric perpendicularity. For instance, the terms "orthogonal" and "perpendicular" as used in the present disclosure are intended to include typical deviations from geometric perpendicularity relating to such considerations as, for example, manufacturing and assembly tolerances. Furthermore, certain manufacturing process such as milling, molding, or casting may require positive or negative drafting, edge chamfers and/or fillets, or other features to facilitate any of the manufacturing, assembly, or operation of various components, in which case certain surfaces may not be geometrically perpendicular, but may be perpendicular in the context of the present disclosure.

As used in the present disclosure, the term "orthogonal," when used to describe electromagnetic polarizations, is meant to distinguish two polarizations that are separable. For instance, two linear polarizations that have unit vector directions that are separated by 90 degrees can be considered orthogonal. For circular polarizations, two polarizations are considered orthogonal when they share a direction of propagation, but are rotating in opposite directions.

The previous description of the disclosure is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not to be limited to the examples and designs described herein but is to be accorded the widest scope consistent with the principles and novel features disclosed herein.

What is claimed is:

1. A dual-polarized antenna, comprising:

a plurality of unit cells, each unit cell comprising:

a polarizer coupled between a common waveguide and first and second divided waveguides associated with first and second polarizations, respectively;

a waveguide horn coupled between the common waveguide and a horn port, the waveguide horn having a transition section of increasing waveguide cross-sectional size from the common waveguide to the horn port;

a plurality of individual waveguides dividing the horn port of the waveguide horn, wherein each individual waveguide of the plurality of individual waveguides includes an extension element that extends at least a portion of at least one wall of the each individual waveguide into the waveguide horn; and a plurality of dielectric elements partially filling the plurality of individual waveguides, each dielectric element within a corresponding individual waveguide of the plurality of individual waveguides.

2. The dual-polarized antenna of claim 1, wherein the each dielectric element includes a dielectric member extending along the corresponding individual waveguide and having one or more matching features for matching signal propagation between the corresponding individual waveguide loaded by the dielectric element and free space.

3. The dual-polarized antenna of claim 1, wherein the waveguide horn and the plurality of dielectric elements convert between a plurality of individual signals within respective individual waveguides of the plurality of individual waveguides and a composite signal within the common waveguide.

4. The dual-polarized antenna of claim 1, wherein the each dielectric element has dual plane symmetry in a transverse plane.

5. The dual-polarized antenna of claim 1, wherein the each dielectric element is centrally located within the corresponding individual waveguide.

6. The dual-polarized antenna of claim 1, wherein the each dielectric element includes a central axis along the corresponding individual waveguide and at least one transverse feature extending from the central axis towards a wall of the corresponding individual waveguide.

7. The dual-polarized antenna of claim 1, wherein the plurality of individual waveguides of the each unit cell of the plurality of unit cells is a 2 by 2 array.

8. The dual-polarized antenna of claim 1, wherein the each dielectric element comprises one or more first retention features mating to one or more second retention features along one or more walls of the corresponding individual waveguide to retain the each dielectric element in the corresponding individual waveguide.

9. The dual-polarized antenna of claim 1, wherein the polarizer comprises a septum polarizer.

10. A dual-polarized antenna, comprising:

a plurality of unit cells, each unit cell comprising:

a polarizer coupled between a common waveguide and first and second divided waveguides associated with first and second polarizations, respectively;

a waveguide horn coupled between the common waveguide and a horn port, the waveguide horn having a transition section of increasing waveguide cross-sectional size from the common waveguide to the horn port;

a plurality of individual waveguides dividing the horn port of the waveguide horn; and a plurality of dielectric elements partially filling the plurality of individual waveguides, each dielectric element within a corresponding individual waveguide of the plurality of individual waveguides, wherein the each dielectric element includes a dielectric member extending along the corresponding individual waveguide and having one or more matching features for matching signal propagation between the corresponding individual waveguide loaded by the dielectric element and free space, and wherein the dielectric member of the each dielectric element extends at least partially into the waveguide horn.

11. The dual-polarized antenna of claim 10, wherein the dielectric member includes a tapered section within the waveguide horn.

12. The dual-polarized antenna of claim 10, wherein the one or more matching features includes a plurality of discs separated by one or more gaps.

13. The dual-polarized antenna of claim 10, wherein each individual waveguide of the plurality of individual waveguides includes an extension element that extends at least a portion of at least one wall of the each individual waveguide into the waveguide horn.

14. The dual-polarized antenna of claim 10, wherein the each dielectric element has dual plane symmetry in a transverse plane.

15. The dual-polarized antenna of claim 10, wherein the each dielectric element is centrally located within the corresponding individual waveguide.

16. The dual-polarized antenna of claim 10, wherein the each dielectric element includes a central axis along the corresponding individual waveguide and at least one transverse feature extending from the central axis towards a wall of the corresponding individual waveguide.

17. A dual-polarized antenna, comprising:

a plurality of unit cells, each unit cell comprising:

a polarizer coupled between a common waveguide and first and second divided waveguides associated with first and second polarizations, respectively;

a waveguide horn coupled between the common waveguide and a horn port, the waveguide horn having a transition section of increasing waveguide cross-sectional size from the common waveguide to the horn port;

a plurality of individual waveguides dividing the horn port of the waveguide horn; and a plurality of dielectric elements partially filling the plurality of individual waveguides, each dielectric element within a corresponding individual waveguide of the plurality of individual waveguides, wherein the each dielectric element includes a dielectric member extending along the corresponding individual waveguide and having one or more matching features for matching signal propagation between the corresponding individual waveguide loaded by the dielectric element and free space, and wherein the one or more matching features includes a plurality of discs separated by one or more gaps.

18. A dual-polarized antenna, comprising:

a plurality of unit cells, each unit cell comprising:

a polarizer coupled between a common waveguide and first and second divided waveguides associated with first and second polarizations, respectively;

a waveguide horn coupled between the common waveguide and a horn port, the waveguide horn having a transition section of increasing waveguide cross-sectional size from the common waveguide to the horn port;

a plurality of individual waveguides dividing the horn port of the waveguide horn, wherein the plurality of individual waveguides of the each unit cell of the plurality of unit cells is a 2 by 2 array; and a plurality of dielectric elements partially filling the plurality of individual waveguides, each dielectric element within a corresponding individual waveguide of the plurality of individual waveguides, wherein the plurality of unit cells includes a first unit cell and a second unit cell, wherein the second unit cell is offset from the first unit cell such that a left-most column of the 2 by 2 array of the second unit cell is aligned with a right-most column of the 2 by 2 array of the first unit cell.

19. A dual-polarized antenna, comprising:

a plurality of unit cells, each unit cell comprising:

a polarizer coupled between a common waveguide and first and second divided waveguides associated with first and second polarizations, respectively;

a waveguide horn coupled between the common waveguide and a horn port, the waveguide horn having a transition section of increasing waveguide cross-sectional size from the common waveguide to the horn port;

a plurality of individual waveguides dividing the horn port of the waveguide horn; and a plurality of dielectric elements partially filling the plurality of individual waveguides, each dielectric element within a corresponding individual waveguide of the plurality of individual waveguides, wherein the each dielectric element comprises one or more first retention features mating to one or more second retention features along one or more walls of the corresponding individual waveguide to retain the each dielectric element in the corresponding individual waveguide, and wherein each of the one or more first retention features is a tab, and each of the one or more second retention features is a retention hole.

20. A dual-polarized antenna, comprising:

a plurality of unit cells, each unit cell comprising:

a polarizer coupled between a common waveguide and first and second divided waveguides associated with first and second polarizations, respectively;

a waveguide horn coupled between the common waveguide and a horn port, the waveguide horn having a transition section of increasing waveguide cross-sectional size from the common waveguide to the horn port;

a plurality of individual waveguides dividing the horn port of the waveguide horn; and a plurality of dielectric elements partially filling the plurality of individual waveguides, each dielectric element within a corresponding individual waveguide of the plurality of individual waveguides, wherein the dual-polarized antenna comprises a first planar assembly including the plurality of individual waveguides for the plurality of unit cells and a second planar assembly including the common waveguides of the plurality of unit cells, wherein the second planar assembly is perpendicular to the first planar assembly.

21. The dual-polarized antenna of claim 20, wherein the dual-polarized antenna further comprises a third planar assembly including the waveguide horns for the plurality of unit cells, the third planar assembly parallel to the first planar assembly.

22. The dual-polarized antenna of claim 20, wherein the second planar assembly comprises a waveguide feed network comprising a plurality of waveguide combiner/dividers coupled between the first and second divided waveguides of the plurality of unit cells and first and second polarization ports of the dual-polarized antenna, respectively.

23. A method for designing a partially dielectric loaded dual-polarized antenna, the method comprising:

identifying an operational frequency range for the dual-polarized antenna, wherein the dual-polarized antenna comprises a plurality of individual waveguides, and wherein a subset of individual waveguides of the plurality of individual waveguides are coupled with a common waveguide of a polarizer via a waveguide horn having a transition section of increasing waveguide cross-sectional size from the common waveguide to the subset of individual waveguides;

determining dimensions of the plurality of individual waveguides for the dual-polarized antenna based on the operational frequency range;

providing a dielectric element partially filling a corresponding individual waveguide of the plurality of individual waveguides; and iteratively adjusting one or more features of the dielectric element and calculating one or more performance metrics of the dual-polarized antenna until one or more of the calculated one or more performance metrics reach predetermined performance values at one or more frequencies within the operational frequency range.

24. The method of claim 23, wherein the one or more performance metrics are calculated at each of a plurality of frequencies within the operational frequency range, and the one or more features of the dielectric element are adjusted until the one or more of the calculated one or more performance metrics reach the predetermined performance values at each of the plurality of frequencies.

25. The method of claim 23, wherein the dielectric element comprises a dielectric member extending along the corresponding individual waveguide and having one or more matching features for matching signal propagation between the corresponding individual waveguide loaded by the dielectric element and free space.

26. The method of claim 25, wherein the adjusting of the one or more features of the dielectric element comprises adjusting the one or more matching features.

27. The method of claim 25, wherein the adjusting of the dielectric element comprises adjusting one or more of a section of the dielectric member extending within the waveguide horn, one or more transverse features of the dielectric member extending from a central axis of the dielectric member towards a wall of the corresponding individual waveguide.

28. The method of claim 23, wherein the operational frequency range includes a plurality of discontinuous frequency segments.

29. The method of claim 23, wherein the one or more performance metrics comprise one or more of a gain, a realized gain, a directivity, a cross-polarization, or antenna pattern side lobes.

* * * * *